US006072974A

United States Patent [19]

Ochiai et al.

[11] Patent Number: 6,072,974

[45] Date of Patent: Jun. 6, 2000

[54] IMAGE FORMING DEVELOPING METHOD

[75] Inventors: Masahisa Ochiai, Fukaya; Masumi Asanae; Toshihiko Noshiro, both of Kumagaya; Koji Noguchi, Saitama, all of Japan

[73] Assignee: Hitachi Metals, Ltd., Tokyo, Japan

[21] Appl. No.: 08/917,686

[22] Filed: Aug. 26, 1997

Related U.S. Application Data

[62] Division of application No. 08/385,418, Feb. 8, 1995, Pat. No. 5,717,983.

[30] Foreign Application Priority Data

| | | | |
|---|---|---|---|
| Feb. 9, 1994 | [JP] | Japan | 6-15072 |
| Feb. 9, 1994 | [JP] | Japan | 6-15073 |
| Mar. 17, 1994 | [JP] | Japan | 6-46289 |
| May 19, 1994 | [JP] | Japan | 6-105119 |

[51] Int. Cl.[7] ..... G03G 15/09

[52] U.S. Cl. ..... 399/270; 430/122

[58] Field of Search ..... 399/267, 270, 399/277, 285; 430/122

[56] References Cited

U.S. PATENT DOCUMENTS

| | | | |
|---|---|---|---|
| 3,847,604 | 11/1974 | Hagenbach et al. . | |
| 4,420,242 | 12/1983 | Yamashita . | |
| 4,553,500 | 11/1985 | Itaya et al. | 399/270 |
| 4,657,374 | 4/1987 | Kuramoto et al. | 399/270 |
| 4,679,929 | 7/1987 | Haneda et al. | 399/231 |
| 4,800,147 | 1/1989 | Savage . | |
| 5,023,666 | 6/1991 | Shimazaki et al. . | |
| 5,396,317 | 3/1995 | Osawa et al. . | |
| 5,483,329 | 1/1996 | Asanae et al. . | |
| 5,565,966 | 10/1996 | Ochiai et al. | 399/274 |
| 5,717,983 | 2/1998 | Ochiai et al. | 399/150 |

FOREIGN PATENT DOCUMENTS

| | | |
|---|---|---|
| 57-130407 | 8/1982 | Japan . |
| 59-905 | 1/1984 | Japan . |
| 59-226367 | 12/1984 | Japan . |
| 62-201463 | 9/1987 | Japan . |
| 63-35984 | 7/1988 | Japan . |
| 3-122686 | 5/1991 | Japan . |
| 3-138674 | 6/1991 | Japan . |
| 3-259283 | 11/1991 | Japan . |
| 4-70782 | 3/1992 | Japan . |
| 5-019662 | 1/1993 | Japan . |
| 5-216324 | 8/1993 | Japan . |
| 5-333591 | 12/1993 | Japan . |
| 2 150 465 | 7/1985 | United Kingdom . |

*Primary Examiner*—Robert Beatty

*Attorney, Agent, or Firm*—Finnegan, Henderson, Farabow, Garrett & Dunner

[57] ABSTRACT

An image forming method for operating a moving image-bearing member bearing an electrostatic latent image and a plurality of developing units disposed near the image-bearing member and being selectively operable is described. The color image forming method develops the electrostatic latent image by using a magnetic developer brush formed on the surface of a developer support and conveyance means, and includes the steps of: providing a rotating cylinder for supporting and conveying the magnetic developer, the cylinder including a permanent magnet with a plurality of magnetic poles on the cylinder surface; supplying a magnetic developer containing non-magnetic color toner for color image formation; attracting and conveying a layer of magnetic developer having a smaller thickness than the gap between the image-bearing member and the developer support and conveyance cylinder on the cylinder surface; and applying in the developing region an alternate electric field with an AC bias superimposed on a DC bias between the image-bearing member and the magnetic developer for the developing of an electrostatic latent image on the image-bearing member. The method also includes a surface magnetic flux density ranging from 50 to 1200 G, and a value of h, defined as $\pi D \cdot V_p/(M \cdot V_m)$, of 2 or less wherein $V_p$ (mm/s) is the moving speed of the image-bearer, and D (mm), M, and $V_m$ (mm/s) are the outer diameter, the number of magnetic poles, and the peripheral speed of the permanent magnet, respectively.

3 Claims, 6 Drawing Sheets

IMAGE FORMING DEVELOPING METHOD

This is a divisional of application Ser. No. 08/385,418, filed Feb. 8, 1995, now U.S. Pat. No. 5,717,983.

BACKGROUND OF THE INVENTION

The present invention relates to an image forming method for developing an electrostatic latent images formed on the surface of an image-bearing member by using a magnetic developer held on the surface of a cylindrical developer conveying member made of a permanent magnet.

Conventionally, an image forming method in which an electrophotography or electrostatic recording is applied to a printer, facsimile machine, and other printing devices, is comprises steps as follows: forming an electrostatic latent images on the surface of an image-bearing member drum shaped, for example, attract magnetically and convey the magnetic developer on the surface of a developing roller provided opposite to this image-bearing member, and comprising a non-magnetic sleeve and a permanent magnet inside the sleeve and relatively rotatable. Thereafter, with the formation of a magnetic brush in the developing region, rub the electrostatic latent image formed surface on said image-bearing member with this bush, thereby the electrostatic latent image is visualized as a toner image. It is the most common step to heat-fix the developed toner image after transferring it onto transfer sheet such as plain paper.

In a development and fixation means as above, since not a small amount of toner remains on the image-bearing member after transferring the toner image onto the transfer sheet, a cleaning device is ordinarily provided to remove the residual toner. From this arises a problem in that a space for said cleaning device must be secured around the image-bearing drum, thereby hindering the entire structure inclusive of a printer from being made compact.

Known as one example of means for solving the problem and aiming at the miniaturization of the whole device are the omission of said cleaning device and the provision of a so-called developing and cleaning unit for removing residual toner remaining on the image-bearing member after transferring as well as for developing an electrostatic latent image in the developing region where the image-bearing member and developing roller are opposed to each other.

In the conventional developing method mentioned above, since a magnetic developer is attracted magnetically and conveyed on the surface of a sleeve positioned outside the permanent magnet and a magnetic brush is formed on the surface of the sleeve in the developing region, the magnetic developer is conveyed through a frictional force with the surface of a sleeve, and its conveyability and the shape stability of a magnetic brush are mainly depended on a frictional coefficient of the surface of the sleeve.

Consequently, the surface of the sleeve is ordinarily formed into a rough surface, but is worn out and becomes smooth during use of long period and therefore the frictional coefficient changes with the lapse of time or sometimes changes locally. Not only the conveyability but also the shape and/or stability of a magnetic brush thus changes. Thus, when performing one development per turn of the image-bearing member by using a magnetic brush in said developing and cleaning unit, no residual toner is completely removed if there is a residual toner after transferring of a toner image onto transfer sheet on the image-bearing member and residual toner may deposite to and remain on the previous electrostatic latent image formed area even after developing.

There is a problem in that such poor removing of a residual toner as described above considerably deteriorates the quality of an obtained image. Therefore, to solve such a problem, there is also a scheme for the complete removing of said residual toner by using a step of performing one development for two turns of an image-bearing member. However, this method has a problem in that the formation speed of images inevitably decreases and the requirement for speedier image bearing cannot sometimes be met.

Meanwhile, to meet a recent increase in the need for a higher quality image, there is a tendency for toner to become smaller in size and, consequently, a mean particle size must be formed of 4 to 9 $\mu$m. Known as an ordinary method for the production of toner is the method by grinding and classifying a raw material after heating, kneading, and cooling. However, a small-particle size toner produced by the aforesaid method is disadvantageous in that it has low fluidity due to the non-sphere shape of particles. Thus, such a developing and cleaning station as described above has a drawback in that it is difficult to completely remove residual toner after transferring.

Incidentally, when a large amount of fluidity-improver such as fine particles of silica is added to improve the fluidity of the aforesaid small-particles size toner, in spite of improved fluidity, disadvantages occur in that the surface of an image-bearing member is damaged and a large change in charge quantity of toner due to a change in humidity becomes larger.

A conventional method for forming a color image has been carried out as follows:

FIG. 6 is an explanatory drawing of the main constitution showing one example of a color image forming device without the use of a conventional intermediate transfer medium. In FIG. 6, the image-bearing drum 101, including an image-bearing surface (not shown) shaped like a cylinder and comprising photosensitive layer such as zinc oxide or organic semiconductor on the peripheral surface, is provided so as to be rotatable in the direction of the arrow. Developing unit 102Y, 102M, 102C, 102BK contain magnetic developer comprising yellow, magenta, cyan, and black toners, respectively, at the opening of which a rotatably installed developing roller 103 is disposed near said image-bearing drum 101.

Most generally, the developing roller 103 comprising a coaxially inserted and relatively rotatable composite of a permanent magnet with a plurality of axially extending magnetic poles provided on the peripheral surface and a sleeve shaped like a hollow cylinder made of non-magnetic material, for example, is for developing an electrostatic latent image formed on the surface of said image-bearing drum 101 attracting magnetically the magnet developer on the surface of the sleeve and forming the magnetic brush.

Near the peripheral surface of the image-bearing drum 101 are provided a charger 104, a transfer means 105, and a cleaner 106. Downstream of the transfer means 105 in the paper feed path 108 is provided a fixer 107, comprising a pressure contact and rotatable composite of a heat roller 107*a* and a pressure roller 107*b*.

According to the constitution described above, the image-bearing drum 101 rotates in the direction of the arrow, the surface of which is uniformly charged by means of the charger 104, for example illuminating an exposure L corresponding to image information for yellow, the first color, leads to formation of electrostatic latent image. When this electrostatic latent image reaches the developing unit 102Y, the developing unit 102Y begins to function and yellow toner is supplied to said electrostatic latent images by the developing roller 103 so that a yellow image is formed.

The image-bearing drum 101 carrying said yellow image successively passes the inactive developing unit 102M, 102C, and 102BK, the transfer unit 105, and the cleaner 106, then charging with the charger 104 and illuminating an exposure L corresponding to an image information of magenta, the second color, leads to formation of an electrostatic latent image in magenta. From this electrostatic latent image, a magenta image is formed by using the developing unit 102M for holding a magenta color. Further, after a similar process, each individual colored image is superimposed to form a full color image on the image-bearing drum 101.

When said color image reaches the transfer unit 105, paper P is supplied simultaneously with this and the color image is transferred to the paper P, then is fixed by means of the fixer 107. The residual toner remaining not yet transferred to the paper P at the transferring, is removed from the surface of the image-bearing drum 101 by using the cleaner 106, followed by the next image formation process.

As said conventional magnetic developer to be used for a color image formation is used a two-component magnetic developer, mainly comprising a non-magnetic color toner and magnetic carrier. However, the two-component magnetic developer to be used in this case must be controlled to maintain the toner concentration within definite limits and, accordingly, a toner concentration control device must be provided in each one of the developing unit 102Y, 102M, 102C, and 102BK. Although an ordinary image forming device has a single developing unit, a color image forming device needs four developing unit. Thus, there are problems in that the provision of a toner concentration control device in each developing unit complicates not only the constitution of the whole apparatus but also maintenance and manipulation and further hinders miniaturization and cost saving.

Formation of a color image without use of an intermediate transfer medium must proceed from one process to another for the superimposition of individual colored images and consequently, undesired toner may attach to the non-image area, thereby lowering the image quality. To solve this drawback, a so-called non-contact developing process is proposed wherein a magnetic brush kept away from contact with the image-bearing drum 101 as an image-bearing means have been proposed, e.g., Japanese Patent Laid-Open Publication No. 216324/1993.

However, conventional devices including that proposed above have drawbacks in that the constitution of the developing roller 103 to insert a hollow cylinder-shaped sleeve outside the permanent magnet as a magnetic field generation means lowers the magnetic flux density on the surface of the sleeve, thereby reducing the magnetic attraction force of the magnetic developer.

Also, an arrangement in which the permanent magnet is fixed and magnetic developer is magnetically attracted and conveyed by a rotation of the sleeve has problems in that the wearing of the surface of the sleeve causes the conveyability to vary in time series or locally, thereby bringing about a shape instability of the magnetic brush and also an unstable developing ability.

Further, since the thickness of the developer layer increases and a magnetic brush happens to stand up near the magnetic poles of permanent magnet, magnetic developer to be attracted and conveyed on the surface of the sleeve has drawbacks in that toner in magnetic developer scatters and mixes with other-colored toner, thereby lowering the image quality. A further problem lies in that, to prevent the scattering of toner and contamination of colors, the concentration of toner must be kept lower than, say, 7 weight %, thereby bringing about lowering of the image density.

Recently, requirements for the miniaturization of devices used for image formating process have been intensified and it has become important to miniaturize the developing unit. As a means for satisfying these requirements, it has been proposed to attract magnetic developer directly on the surface of permanent magnet member without using a sleeve and to convey magnetic developer by a rotation of a permanent magnet member (e.g. Japanese Patent Laid-Out Publication No. 201463/1987).

FIG. 5 is an explanatory drawing of the main part showing one example of sleeveless type developing unit as described. In FIG. 5, a developing container 201 contains a magnetic developer 202 mainly comprising, say, toner and a magnetic carrier, under which a permanent magnet 204 is rotatably provided. The permanent magnet 204 is formed in such manner as to be conductive at least on the surface, on the peripheral surface of which a plurality of axially extending magnetic poles is provided in a cylindrical form.

Said permanent magnet 204 can be formed of a resin bonded magnet comprising a mixture of ferromagnetic powder and resin (cf. Japanese Patent Laid-Open Publication No. 130407/1982, No. 905/1984, and No. 226367/1984). As a means for making the surface conductive, it is allowable to form a conductive layer on the surface by plating for example, or to add an electro-conductive powder during kneading of raw materials. It is also possible to make the permanent magnet 204 semiconductive by making it of a hard-ferrite magnet.

An image-bearing drum 203, formed in such a manner as to be rotatable in the direction of the arrow, is opposed to the permanent magnet 204 via a gap g. A doctor blade 205, provided in the developer vessel 201, is opposed to the permanent magnet 204 via a gap t and serves to regulate the layer thickness of magnetic developer 202 to be attracted on the surface of the permanent magnet 204. A charging roller 206, a transfer roller 207, and a cleaning device 208 are disposed around the image-bearing drum 203, with the surface of which a doctor blade 209 is in contact. Incidentally, to magnetic developer 202 to be attracted on the permanent magnet 204 is applied via the permanent magnet 204 or the doctor blade 205 a bias voltage supplied from the DC power supply (not shown).

According to the constitution described above, on rotating in the direction of the arrow the image-bearing drum 203, charging roller 206, permanent magnet 204, and transfer roller 207 individually, the surface of the image-bearing drum 203 is uniformly charged by means of the charging roller 206. On illuminating an optical signal (not shown) onto the image-bearing drum 203, an electrostatic latent image is formed. When magnetic developer 202 is attracted onto and conveyed by the permanent magnet 204 and gets to the developing region opposite the image-bearing drum 203, toner in the magnetic developer 202 is put in the electric field of an electrostatic latent image formed on the image-bearing drum 203 and the electrostatic latent image can be developed.

The developed toner image is transferred to paper P by means of the transfer roller 207, moves in the direction of the arrow, and is fixed. Residual toner that remains on the image-bearing drum 203 after image transfer, is scraped off with a cleaning blade 209 in rubbing contact with the surface of the image-bearing drum 203 and is collected in the cleaning device 208.

Used as a two-component magnetic developer in the image formation device described above is magnetic developer 202 comprising a mixture material of, say, magnetic toner with a particle size distribution between 5 and 20 μm and a ferrite carrier with a particle size distribution between 70 and 140 μm. Incidentally, there are also cases where non-magnetic toner is used in place of magnetic toner.

In these cases, the use of small particle size toner is needed for formation of a fine image. There is a problem in that, in using large-particle size magnetic carrier as described, the poor capability of giving electric charge to toner is apt to induce the generation of fog, thereby lowering the quality. Accordingly, not only to obtain a fine image, but also as magnetic carriers, small-particle size toner is required.

However, for the conventional development roller with a sleeve, by use of said small-particle size magnetic carriers, the carrier is likely attach to the image bearing member, leading to a decrease in quality. For an image formation means of such a type as directly attracts and conveys magnetic developer 202 by using the permanent magnet 204 with omission of such a sleeve as shown in FIG. 5, although no carrier attaching occurs, unlike said developing roller with the sleeve, there are other problems in that the use of magnetic carriers having a high magnetic force increases a rotation torque for driving the permanent magnet 204, which is apt to induce spent phenomena that the resin component constituting toner adhere to the surface of magnetic carriers, thus leading to a reduction in the life of magnetic carrier and the generation of fog.

Furthermore, a conventional image formation means has combined problems in that, since toner concentrations in a two-component magnetic developer is 3 to 5 weight % for non-magnetic toner and lies in a relatively narrow range of 20±5 weight % for magnetic toner, a toner concentration control means such as a toner concentration sensor is needed, resulting in low operability and a complicated device.

In addition, when developing an electrostatic latent image by means of said developing roll of a sleeveless type, the use of small-particle size toner, such as 4 to 9 μm in average particle size, is preferred for toner containing in the magnetic developer 202. In recent years, a fine image is required, so that the particle size of toner must be still smaller.

It is known as a general method for the production of toner, to grind and classify blended raw materials after heating, kneading, and cooling. However, the production of small-particle size toner by such a method has problems in that, since a long time is needed for the grinding process, a possible mean particle size is limited to around 7 mm and in that the production work is complicated and the production cost rises.

For these reasons, methods by polymerization have been proposed for the production of small-particle size toner, which polymerization process includes suspension polymerization and disperse polymerization process. These methods permit small-particle size toner to be produced with comparative ease, magnetic developer suitable for said developer of the sleeveless type to be obtained, and a fine, and high-resolution image to be formed.

However, toner produced by an ordinary polymerization process is restricted to that of spherical particles, has difficulty in the uniform dispersion of coloring agent and other blend components into toner particles, and cannot satisfactorily meet the required properties for toner. In particular, toner particles formed in a spherical shape are so large in fluidity that they often pass between the image bearing member and blade in the blade cleaning means representative of an ordinary cleaning scheme, thus entailing a problem in incomplete removal and collection of the residual toner on the surface of an image-bearing drum 203.

SUMMARY OF THE INVENTION

It is the purpose of the first invention to provide an image forming method herein enabling the removal and collection of residual toner is complete on the surface of image-bearing member and the minimization of the entire device.

To achieve the purpose, the first invention adopts a developing method for developing an electrostatic latent image on an image-bearing member that moves bearing electrostatic latent images by using a two-component magnetic developer, comprising the technical steps of: constructing the means for the support and conveyance of said magnetic developer out of a permanent magnet with a plurality of magnetic poles provided on the surface in a cylindrical shape and rotatable manner; and rubbing the surface of the image-bearing member with a magnetic brush composed of magnetic developer attracted adsorbed on the surface of said permanent magnet and developing the electrostatic latent image into a toner image before the transfer to a transfer medium; wherein both the removal of the residual toner remaining on the surface of the image-bearing member after the finish of the last transfer and the developing of the electrostatic latent image is performed while rubbing the surface of said image-bearing member with said magnetic brush.

In the present invention, toner in a two-component magnetic developer comprises pulverized powder and magnetic developer containing 50% or less of it can be employed.

Also, in the present invention, toner in a two-component magnetic developer comprises spherical powder obtained by a polymerization means and a magnetic developer containing 20% or less of it can be employed.

Further, the present invention can form images on the conditions that, letting Vp (mm/s) be the moving speed of the image-bearing member, and D (mm), M, and Vm (mm/s) be the outer diameter, the number of magnetic poles, and peripheral speed of the permanent magnet, respectively, a value of h (mm) expressed as $\pi D \cdot Vp/M \cdot Vm$ is 2 or less, and surface magnetic flux density ranges from 50 to 1200 G.

It is the purpose of the second invention to provide a color image forming method that can enable miniaturization and cost saving in a device without scattering toner or contamination of colors.

To achieve the purpose mentioned above on the provision of an image-bearing means that moves bearing an electrostatic latent image and a plurality of developing roll disposed opposite to the image-bearing means and selectively operable, the second invention adopts a color image forming method for developing said electrostatic latent image by using a magnetic brush formed on the surface of a developer support and conveyance means constituting the relevant developer, comprising the technical steps of: constructing the means for the support and conveyance of said magnetic developer out of a permanent magnet with a plurality of magnetic poles provided on the surface in a rotatable manner and cylindrical shape; using magnetic developer containing non-magnetic color toner for color image formation at least excepting a black image; attracting and conveying magnetic developer having a smaller layer thickness than the gap between the image-bearing means and said developer support and conveyance means on the surface of a developer support and conveyance means; and applying in the development region an alternate electric field with AC bias superimposed on DC bias between the image-bearing means and the magnetic developer for the development of an electrostatic latent image on the image-bearing means.

The present invention can employ a magnetic developer containing 5 to 60 weight % of non-magnetic color toner.

Also, the present invention can perform color image formation on conditions letting Vp (mm/s) be the moving speed of the image-bearer, and D (mm), M, and Vm (mm/s) be the outer diameter, the number of magnetic poles, and peripheral speed of the permanent magnet, respectively, a value of h (mm) expressed as $\pi D \cdot Vp/M \cdot Vm$ is 2 or less, and surface magnetic flux density ranges from 50 to 1200 G.

It is the purpose of the third invention to provide an image forming method wherein torque needed for the support and conveyance of magnetic developer is small and high-quality image formation is enabled in a wide range.

To achieve the purpose, the third invention adopts an image forming method for developing an electrostatic latent image on an image-bearing member that moves bearing electrostatic latent images by using a two-component magnetic developer, comprising the technical steps of: constructing the means for the support and conveyance of said magnetic developer out of a permanent magnet with a plurality of magnetic poles provided on the surface in a rotatable manner and cylindrical shape; preparing magnetic carriers in the magnetic developer attracted and conveyed on the surface of the permanent magnet, ranging 5 to 20 $\mu$m in average particle size and opposite to toner in polarity of charge; and forming the magnetization $\sigma_{1000}$ in a magnetic field of 1000 Oe at 50 emu/g or less.

The present invention can use magnetic developer containing 5 to 80 weight % of toner.

Also, the present invention can perform color image formation on conditions letting Vp (mm/s) be the moving speed of the image-bearing member, and letting D (mm), M, and Vm (mm/s) be the outer diameter, the number of magnetic poles, and peripheral speed of the permanent magnet, respectively, a value of h (mm) expressed as $\pi D \cdot Vp/M \cdot Vm$ is 2 or less, and surface magnetic flux density ranges from 50 to 1200 G.

It is the purpose of the fourth invention to provide an image forming method permitting a high-quality image formation wherein removal and collection of the residual toner remaining on the surface of an image-bearing member is complete and miniaturization of the whole system is enabled.

To achieve the purpose mentioned above, the fourth invention adopts an image forming method for developing an electrostatic latent image on a image-bearing member that moves bearing electrostatic latent images by using a magnetic developer and for removing residual toner after transfer of a toner image obtained from development onto the transfer member, employing a permanent magnet with a plurality of magnetic poles provided on the surface in a rotatable manner and cylindrical shape as the means for the support and conveyance of said magnetic developer and comprising the technical steps of: forming an electrostatic latent image into a toner image by attracting and conveying magnetic developer comprising nonglobular magnetic toner obtained by a polymerization means or else comprising nonglobular magnetic or nonmagnetic toner obtained by a polymerization means and magnetic carriers; and removing residual toner, through a doctor blade, which remains on the image-bearer after transferring this toner image.

The present invention can perform color image formation on conditions letting Vp (mm/s) be the moving speed of the image-bearer, and letting D (mm), M, and Vm (mm/s) be the outer diameter, the number of magnetic poles, and peripheral speed of the permanent magnet, respectively, a value of h (mm) expressed as $\pi D \cdot Vp/M \cdot Vm$ is 2 or less, and surface magnetic induction ranges from 50 to 1200 G.

The permanent magnet in the first, second, third, and fourth inventions mentioned above is not limited to a ferrite magnet but may be a resin bonded magnet mainly comprising magnetic powder and resin material. Further, this permanent magnet may be a one-piece role-like magnet formed on the periphery of the shaft or a shaft-inclusion component formed entirely of magnetic material. However, to prevent unevenness of image density, this permanent magnet may have no joint in the circumferential and axial directions and may be formed in one piece as a whole.

Since heteropolar magnetic poles are alternately disposed on the surface of said permanent magnet at minute intervals in the circumferential direction, the surface magnetic flux density reduces with the increasing number of magnetic poles. From the standpoint of preventing the scatter of magnetic developer, however, the surface magnetic flux density of a permanent magnet is preferably 50 G or more, whereas it is preferably 1200 G or less so that toner may attach easily to an electrostatic latent image formed on the surface of an image-bearing member. The number of magnetic poles is set preferably at 8 to 60 poles corresponding to 50 to 1200 G of said surface magnetic flux density. Incidentally, the surface magnetic flux density is more preferably at 100 to 800 G.

Next, with larger numbers of magnetic poles, the magnetic field formed around the permanent magnet becomes smaller and the amount of magnetic developer deposited on the surface of the permanent magnet decreases. Consequently, since the thickness of the magnetic developer layer formed on the surface of the permanent magnet is apt to become uneven, the permanent magnet must be rotated at a high speed to prevent such undesirable phenomena. However,if the rotation speed of the permanent magnet is too high, the drive torque becomes large or wear occurs in carriers containing in the magnetic developer. If the rotation speed of the permanent magnet is too low, however, uneven density appears in the image. Thus, the peripheral speed Vm (mm/s) of a permanent magnet is set preferably 1 to 20 times, more preferably 4 to 10 times, Vp (mm/s) of an image-bearing member.

Letting D (mm) and M be the outer diameter and the number of magnetic poles, respectively, it is preferred to set values of D, M, and Vm so that a value of h expressed as $\pi D \cdot Vp/M \cdot Vm$ is less than 2.

Said h denotes a pitch that the surface of the image-bearing member faces the magnetic poles of the permanent magnet per a unit time. Since uneven image density is remarkable if h is 2 or more mm, h is preferably less than 2 mm and more preferably less than 1 mm. In this case, for a smaller value of h, it is only necessary to make the number M of magnetic poles and the peripheral speed Vm greater. Too large a number M of magnetic poles will lower the surface magnetic flux density, thereby causing scattering of a magnetic developer readily, whereas too high a peripheral speed Vm will induce disadvantages as described. Thus, a practical value of h is set preferably at 0.4 to 1.0 mm.

In providing a doctor blade gap t, a gap between the surface of a permanent magnet and the tip of a doctor blade, in comparison with a development gap g, a gap between a permanent magnet and image-bearing member, it is preferred from the standpoint of image quality to set a difference (g−t)=0.2±0.15 mm. In addition, it is also allowable to bring the doctor blade mentioned above in contact or pressed against the surface of a permanent magnet, i.e., t=0. In this case, it is only necessary to form a doctor blade of magnetic materials, such as SK material, or non-magnetic materials, such as austenic stainless steel (for example SUS 304) or phosphur bronze, like an elastic blade, one end fixed to the developer container, the other in contact with the surface of the permanent magnet.

In particular for the first invention, since the permanent magnet is formed of semiconductive or insulating materials, it is preferred in application thereto to apply a bias voltage from a doctor blade. It is thus only necessary to form the doctor blade of conductive materials such as metal.

An AC voltage to be superimposed on a DC voltage is preferably of a comparative low frequency not higher than 20 kHz and more preferably not higher than 10 kHz. The peak-to-peak value Vp-p ranges preferably from 100 to 2,000 V, more preferably from 200 to 1,200 V.

As a two-component magnetic developer, it is advisable to apply an adjusted one to a predetermined concentration in the developer container or to deposit carriers on the surface of the permanent magnet and feed only toner into the developer container. This dispenses with the toner concentration control means and permits a miniaturization of the developing device.

As carriers containing in a magnetic developer, magnetic particles, such as binder particles with fine magnetic powder dispersed in the resin, iron particles, ferrite particles, magnetite particles, can be employed which have a mean particle size of 10 to 150 $\mu$m and magnetization $\sigma_{1000}$ of 30 or more emu/g as measured in a magnetic field of 1000 Oe. If the magnetization $\sigma_{1000}$ is less than 30 emu/g, attach to the image bearing member of carriers become apt to occur, thus causing unfavorable effects. In particular, carriers of iron powder in a flat, rather than spherical shape, are preferable because of a good charging ability.

Further, carriers having a mean particle size of 10 to 50 $\mu$m are especially preferred. That is why a sufficient charged amount of toner is obtained for a mean particle size of 50 $\mu$m or under but its attach onto image bearing member is apt to occur for a mean particle size of less than 10 $\mu$m.

Incidentally, mixed carriers of two and more sorts out of the magnetic particles mentioned above are also allowable. For example, a mixture of large-particle-sized magnetic particles, 60 to 120 $\mu$m in mean diameter, and small-particle-sized magnetic particles, 10 to 50 $\mu$m in mean diameter, or small-particle-sized binder type magnetic particles, 10 to 50 $\mu$m in mean diameter, are allowable. The mixing ratio should be determined from a consideration of size, magnetic characteristics, or other properties of magnetic particles.

Now, as toner to be mixed with the carriers mentioned above, either of magnetic or non-magnetic ones will do. From the standpoint of promotion in transferability, insulating toner having a specific volume resistivity of $10^{14}$ Ω.cm or more is preferred and one easily charged by friction with carriers, and the doctor blade etc.(amount of triboeletric charge: 10 $\mu$c/g or more in absolute value) is preferred.

As with ordinary toner, the essential components of toner are binding resin (e.g., styrene-acrylic copolymer, polyester resin), coloring agent (e.g., carbon black, however, no particular addition is necessary when using magnetite as magnetic powder for a black image described later), and the optional component contains (internally and/or externally) magnetic powder (e.g., magnetite and soft ferrite), charging control agent (e.g., nigrosine, metal-contained azo dyes), mold releasing agent (e.g., polyolefin), fluidizing agent (e.g., hydrophobic silica). In using magnetic toner, since the scatter of toner increases with smaller amounts of magnetic powder while the fixativity is reduced with larger amounts of magnetic powder, the content of magnetic powder ranges preferably from 20 to 70 weight %. Further, by a proper selection of coloring agents, color toner may be prepared.

In particular, with the ground powder of toner, the content in a magnetic developer is preferably 50 weight % or under. That is why background fog increases and the cleaning degree falls for more than 50 weight %.

With the spherical powder of toner obtained by the polymerization means, the content in a magnetic developer is preferably 20 weight % or less. That is why background fog increases and the cleaning degree falls for more than 20 weight %.

Incidentally, the measurements of magnetization values described above were made using a vibrating sample magnetometer (Toei Industry Co., Ltd., Model VSM-3) and those of mean particle size (volume) of toner were made using a particle size analyzer (Coulter Electronics Inc., Coulter counter model TA-II).

With 10-odd mg of 100 gf loaded sample filled in a trade-named Teflon cylinder of 3.05 mm inner diameter under an electric field of DC 4 kV/cm, values of specific volume resistivity were measured by means of an insulation resistance tester (YOKOGAWA Hewllette-Packard, 4329 A). Further, values of amount of triboelectric charge were measured at a 5 wt % concentration of toner (ferrite carriers (Hitachi Metals Ltd., KBN-100) used as reference carriers) by means of a commercially available blow-off triboelectric charge measuring equipment (Toshiba Chemical Inc., TB-200). The constitution mentioned above permits a combined execution of removal of the residual toner and development of an electrostatic latent image by rubbing the surface of the image-bearing member with a magnetic brush formed directly on the outer surface of the permanent magnet constituting a means for supporting and conveying a magnetic developer in a sleeveless structure. Use of small-particle-sized toner also permits a complete removal of the residual toner on the surface of the image-bearing body. Thus, even in a constitution without a cleaning means, a high-quality image free of background fog can be developed and miniaturization of the whole device is enabled.

In the second invention, use of an intermediate transfer drum or belt for image formation of a color image dispenses each color developing unit from being made into a non-contact developing type, but 4 turns of an image-bearing means, e.g., an image-bearing drum, is needed for formation of one full-colored image. In addition, moving of a color developing unit is needed for every development or a means for preventing the formation of a magnetic brush is necessary.

In the case of development by magnetic brush contact as described above, the layer thickness of a magnetic developer need not be smaller than the gap in developing region. Also in contact development, however, a color image forming method according to the present invention is effectively applicable on account of advantages such as a wide applied range of toner concentration wherein a means for supporting and conveying developer, comprising a permanent magnet with a plurality of magnetic poles provided on the surface in a cylindrical shape and ratable manner, attracts and conveys a magnetic developer on its surface. Incidentally, the superimposition of DC bias is not necessary for magnetic brush contact development.

A permanent magnet in the present invention may be conductive, or semiconductive or insulating (volume resistivity>$10^6$ Ω.cm). However, for the member made of semiconductive or insulating materials through the doctor blade that a bias voltage is applied, where the doctor blade should be made of conductive materials such as metal.

In using an AC voltage to be superimposed on the DC voltage, a comparative low frequency of not higher than 20 kHz is preferable, a more preferable frequency is not higher than 10 kHz. The peak-to-peak value Vp-p ranges preferably from 100 to 2,000 V, more preferably from 200 to 1,200 V.

As a two-component magnetic developer, it is advisable to apply the adjusted developer to a predetermined concentration in the developer container or to deposit carriers on the surface of the permanent magnet and then feed only toner into the developer container. This dispenses with the toner concentration control means and permits miniaturization of the developing device.

As carriers containing in a magnetic developer, magnetic particles, such as iron powder, ferrite, magnetite, or binder particles with magnetic powder dispersed in resin, can be employed which have a mean particle size of 10 to 150 μm and magnetization $\sigma_{1000}$ of 30 or more emu/g as measured in a magnetic field of 1000 Oe. If the magnetization $\sigma_{1000}$ is less than 30 emu/g, deposit of carriers become apt to occur, which case is unfavorable. In particular, carriers of iron powder a flat, rather than spherical shape, are preferable because of a good charging ability.

Further, carriers having a mean particle size of 10 to 50 μm are especially preferred. That is why a sufficiently charged amount of toner is obtained for a mean particle size of 50 μm or under but its attach onto the image bearing member is apt to occur for a mean particle size of less than 10 μm Incidentally, mixed carriers of two and more sorts out of the magnetic particles mentioned above are also allowable. For example, a mixture of large-particle-sized magnetic particles, 60 to 120 μm in mean diameter, and small-particle-sized magnetic particles, 10 to 50 μm in mean diameter, or small-particle-sized binder magnetic particles, 10 to 50 μm in mean diameter are allowable. The mixing ratio should be determined from the consideration of size, magnetic characteristics, or other properties of magnetic particles.

Now, as toner to be mixed with the carriers mentioned above, either of magnetic or nonmagnetic ones will do. A color image except for a black image should be nonmagnetic. From the standpoint of promotion in transferability, insulating toner having a specific volume resistivity of $10^{14}$ Ω.cm or more is preferred and the one easily charged by friction with carriers, the doctor blade etc. (amount of triboelectric charge: 10 μc/g or more in absolute value) is preferred.

As with ordinary toner, the essential components of toner are binding resin (e.g., styrene-acrylic copolymer, polyester resin), coloring agent (e.g., carbon black, coloring pigments, however, no particular addition is necessary when using magnetite as magnetic powder in a later case), and the optional component contains (internally and/or externally) magnetic powder (e.g., magnetite, soft ferrite, etc.), a charging control agent (e.g., nigrosine, metal-contained azo dyes), mold releasing agent (e.g., polyolefin), fluidizing agent (e.g., hydrophobic silica). In using magnetic toner, since the scatter of toner increases with smaller amounts of magnetic powder while the fixativity is reduced with larger amounts of magnetic powder, the content of magnetic powder ranges preferably from 20 to 70 weight %.

In the present invention, the toner concentration for a color image except for a black image ranges preferably from 5 to 60 weight %. The image quality is lowered for a toner concentration of less than 5 weight % while fog, spreadness, and fine line unevenness, on the one hand, occur for a toner concentration of more than 60 weight %, thus deteriorating the image quality and accordingly both cases are unfavorable. On the other hand, as toner for a black image, not only binary component system toner but also single component system toner is usable.

Incidentally, the measurements of magnetization values mentioned above were made similarly to those of the first invention. Further, those of specific volume resistivity and amount of triboelectric charge were made similarly to those of the first invention.

The constitution mentioned above permits the formation of a stable magnetic brush by direct attraction of a magnetic developer containing color toner on the outer surface of a permanent magnet and the formation of a high-quality color image without scattering of toner and contaminating of colors. Since the concentration of toner can be set in a wider range than is conventional, a complicated toner concentration control means need not be used, thereby permitting a small-size and low-cost color image forming device to be implemented.

For a permanent magnet made of semiconductive or insulating materials in the third invention, it is preferably through a doctor blade that a bias voltage be applied, where the doctor blade should be formed of conductive materials such as metal. For a permanent magnet made of conductive materials, it is preferably through a shaft that a bias voltage be applied.

As a two-component magnetic developer, it is advisably to apply the adjusted developer to a predetermined concentration in the developer container or to deposit carriers on the surface of the permanent magnet and then feed only toner into the developer container. This dispenses with the toner concentration control means and permits miniaturization of the developing device.

As carriers constituting a magnetic developer, magnetic particles, such as iron powder, ferrite, magnetite, or binder particles with magnetic powder dispersed in resin, can be employed which have a mean particle size of 5 to 20 μm and magnetization $\sigma_{1000}$ of 50 or less emu/g as measured in a magnetic field of 1000 Oe. If the magnetization $\sigma_{1000}$ is more than 50 emu/g, torque required for the adsorption and conveyance of a magnetic developer becomes larger and spent phenomena become likely to occur, thus bringing about a reduction in the life of carrier and generation of fog, which means magnetization range is unfavorable.

Further, a sufficiently charged amount of toner is obtained for carriers having a mean particle size of 20 μm or under but its attach onto the image bearing member is apt to occur for carriers having a mean particle size of less than 5 μm, thus causing unfavorable effects. Incidentally, mixed carriers of two and more sorts out of the magnetic particles mentioned above are also allowable. The mixing ratio should be determined from the consideration of size, magnetic characteristics, or other properties of magnetic particles.

Now, the toner to be mixed with the carriers mentioned above and the essential components of toner are made similarly to those of the first invention. Incidentally, to obtain a fine image, a mean particle size of toner is preferably formed to be 5 to 10 μm.

The content of toner in the present invention is preferably 20 to 80 weight %. That is why the image density is lowered for a toner concentration of less than 5 weight % while background fog increases for a toner concentration of more than 80 weight %, but no such disadvantages occur within the range between 5 and 80 weight %.

Incidentally, the measurements of magnetization values mentioned above were made similarly to those of the first invention. Further, those of specific volume resistivity and amount of frictional electrification were made similarly to those of the first invention.

The constitution mentioned above permits a high-quality image free of background fog to be developed in a wide range of toner concentration by using a small-particle size means for supporting and conveying magnetic developer, having a sleeveless structure.

For a permanent magnet having semiconductive or insulating materials in the fourth invention, it is preferably through a doctor blade that a bias voltage is applied, where the doctor blade should be formed of conductive materials such as metal.

In using an AC voltage to be superimposed on the DC voltage, a comparative low frequency of not higher than 20 kHz is preferable, a more preferable frequency is not higher than 10 kHz. The peak-to-peak value Vp-p ranges preferably from 100 to 2,000 V, more preferably from 200 to 1,200 V.

In the present invention, magnetic or non-magnetic toner constituting a magnetic developer consists of nonglobular particles of at least a mixture of magnetic substance and polymer, or of at least an association or aggregation of polymer, and can be obtained by a publicly known technique such as association or aggregation process.

This method proceeds as follows: Prepare a fine-particle polymer previously; add needed coloring agent, magnetic substance, and other materials thereto; associate or aggregate the mixture into particles having a grain size of around 10 $\mu$m to be used as toner. As one of the methods for preparing a fine-particle polymer, an emulsion polymerization method comprising the steps of emulsifying various monomers with a surface active agent (emulsifier) and adding a polymerization initiator to the emulsion for heat polymerization is known.

The emulsion polymerization process is a method for polymerizing monomers in the presence of water by using a water-soluble initiater under action of an emulsifier. As emulsifiers, anionic emulsifiers such as sodium higher alcohol sulphate and sodium alkylbenzene sulfonate, nonionic emulsifiers, such as alkylphenol ethylene oxide adducts and polypropylene glycol ethylene oxide adducts, and cationic emulsifiers such as quarternary ammonium salt are publicly known.

However, since polar groups originating from used emulsifiers remain on the surface of a polymer obtained by emulsion polymerization, toner using this polymer lowers its charge quantity under high-humidity environments so that image density tends to fall and background fog tends to rise. Thus, the present invention employs preferably a polymer formed by a soap-free emulsion polymerization means containing no surface active agent.

A soap-free polymerization to be employed in the present invention includes a method using a reactive emulsifier, a method for performing emulsifier-free emulsion polymerization in relatively hydrophilic polymeric monomers, such as vinyl acetate and methyl acrylate, with a persulfate salt initiator, a method for copolymerizing an ionic or nonionic water-soluble specially polymeric monomer, a method using a water soluble polymer or oligomer in place of emulsifier, a method using a decomposition emulsifier, and a method using a bridge formation emulsifier. By dispersing and emulsifying a polymeric monomer in a medium chiefly comprising water and adding a water-soluble initiator for polymerization, an emulsion of produced polymer is obtained, then through dehydration and drying to a fine grain polymer containing no surface active agent.

The present invention can employ publicly known magnetic substances, coloring agents, dipersants, polymeric monomers, polymerization initiators (radical-generating agents), bridge formation agents, charging control agent, fluidity improving agent, cleaning agent, and filler.

Dispersants for a magnetic substance are as follows: As silane-coupling agents, γ-methacryloxypropyl trimethoxysilane, and N-β-(N-vinylbenzyl aminoethyl)-γ-aminopropyl trimethoxysilane hydrochloride. Further, titanate coupling agents such as isopropyl triisostearic titanate, and p-styrene sodium sulfonate, p-styrene potassium sulfonate, styrene sodium sulfonate, acrylic acid, methacrylic acid, and p-chlorostyrene.

As to the addition quantity of dispersants, there is no special restriction, but it is advisable to add 0.1 to 10 weight % for 100 weight % of a magnetic substance.

Polymeric monomers to be used in the present inventions are radical polymeric and a kind or a combination of two or more kinds of monomers are used in such a manner that the produced polymer has thermal and electrostatic characteristics required for toner. As examples of such monomers, monovinyl aromatic monomers, acrylic monomers, vinyl ester monomers, vinyl ether monomers, diolefine monomers, and monoolefine monomers are mentioned.

As monovinyl monomers, styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene are mentioned.

As acrylic monomers, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethyl aminoethyl methacrylate, diethyl aminoethyl methacrylate are mentioned.

As vinyl ester monomers, vinyl acetate, vinyl propionate, and vinyl benzoate are mentioned. As vinyl ether monomers, vinyl methyl ether, vinyl ethyl ether, vinyl isobutyl ether, and vinyl phenyl ether are mentioned. As diolefin monomers, butadiene, isoprene, and chloroprene are mentioned. As monoolefin monomers, ethylene, propylene, isobutylene, 1-butene, 1-pentene, and 4-methylpentene-1 are mentioned.

As radical-generating agents or polymerization initiators to be used in the present invention, a kind or a combination of two or more kinds of publicly known polymerization initiators can be used. For example, polymerization can be performed using 2,2'-azo vis(2,4-dimethyl)valeronitrile, 2,2'-azo vis 2,2'-azo vis isobutyronitrile, 4-mothoxy-2,4-dimethyl valeronitrile, benzoyl peroxide, 2,4-dichloro peroxide, isopropyl peroxycarbonate, cumene hydroperoxyde, lauroyl peroxide, and potassium persulfate. The dosage of these polymer initiators is preferably about 0.1 to 2 weight % of a monomer composition as radical-generating agents for the dispersion of a magnetic substance or about 0.1 to 5 weight % of a monomer composition for polymerization of a monomer.

As bridge formation agents, bridging monomers having two or more unsaturated bonds per molecule can be used also for copolymerization. As bridging monomers, divinyl benzene, divinyl naphthalene, divinyl ether, diethylene glycol methacrylate, ethylene glycol dimethacrylate, polyethylene glycol dimethacrylate, and diaryl phthalate are mentioned. The ratio of coplymerizing these bridging monomers with polymeric monomers is preferably 0.2 to 2 weight % of the total amount of monomers.

As coloring agents, publicly known dyes and pigments can be used in addition to magnetic substances. Dyes include, for example, nigrosine dye, C.I. direct red 1, C.I. direct red 4, C.I. acid red 1, C.I. basic red 1, C.I. solvent red, C.I. vat red, C.I. direct blue 1, C.I. direct blue 2, C.I. acid blue 15, C.I. basic blue 3, C.I. solvent blue, C.I. direct green 6, and C.I. solvent red. As pigments, furnace black, acetylene black, cadminium yellow, Hansa yellow G, naphthol yellow S, pyrazolone red, permanent red 4R, molybdenum orange, fast violet B, phthalocyanine blue, malachite green, and phthalocyanine green are mentioned. These coloring agents must be contained at a proportion proper for the formation of a sufficient-density visible image and are mixed normally at 2 to 20 weight % of the whole amount of monomer composition.

As magnetic substances, powder of ferromagnetic metals such as iron, cobalt, and nickel, or fine particles of their alloys with chromium, manganese, copper, zinc, aluminum and rare earth elements, or oxides thereof, such as magnetite and ferrite can be used. The mean particle size of a magnetic substance ranges preferably from 0.1 to 2 $\mu$m. The addition amount of these magnetic substances is preferably 20 to 70 weight % of the total weight of toner.

As charging control agents, nigrosine, quarternary ammonium salt, polyalkyl amide, molybdate chelate pigments, metal complex of monoazo dyes, metal naphthenate salt, and metal salicylate complex are mentioned. The addition amount of these charging control agents is preferably 0.1 to 5 weight % of the total weight of toner.

In the present invention, aside from the components mentioned above, additives such as fluidity improving agents, cleaning agents, and fillers may be added if necessary. As fine polymer particles to be added onto the surface of polymer particles, such polymers or copolymers as polyethylene, polypropylene, polystyrene, polymethylmethacrylate, polyvinylidene fluoride, and polyethylene tetrafluoride are mentioned.

As fluidity improving agents, fine powder of hydrophobic silica, titane oxide, polyvinylidene fluoride, and metallic soap can be used. As cleaning adjuvants, fine powder of zinc stearate, calcium stearate, magnesium stearate, polymethyl methacrylate, nylon, polyethylesilicon cauoride, and silicon carbide can be used. These additives may be used after being mixed and dispersed into a monomer composition or may be added onto the obtained toner particles.

Toner in the present invention can be used by the following amorphous processing even if it is a globular toner made by suspension polymerization or dispersion polymerization:

First, in a method for producing toner particles comprising the step of dispersing a polymeric mixed solution containing a monomer having at least an ethylene unsaturated double bond and coloring agents in water by using a dispersion stabilizer for suspension polymerization, remove the dispersion stabilizer at higher temperatures than the glass transition temperature of the relevant polymer to aggregate polymer particles mutually into amorphous association particles. Then, decompose and grind them into particles having a mean volume particle size of 7.0 or less pm (cf. Japanese Patent Laid-Open Publication No. 100483/1993).

Alternatively, in a method for producing toner particles by suspension polymerizing a monomer mixture solution containing at least a coloring agent, deposit polymer particles onto polymerized particles, then specially shape the particles with a dry ball mill to obtain toner having a form factor of 1.05 to 1.30 in the maximum frequency of particles with fine polymer particles on the surface of a toner particle (cf. Japanese Patent Laid-Open Publication No. 241376/1993).

Next, when using a two-component magnetic developer of a mixture of said magnetic toner or non-magnetic toner and magnetic carriers as a magnetic developer, it is advisable to apply the adjusted one to a predetermined concentration in the developer bath or feed only toner in the developer bath after depositing carriers onto the surface of the permanent magnet. This dispenses with the toner concentration control means and permits miniaturization of the developing device.

As carriers constituting a magnetic developer, magnetic particles (e.g., iron powder, ferrite, magnetite, or binder particles with magnetic powder dispersed in resin), can be employed which have a mean particle size of 10 to 150 $\mu$m and magnetization $\sigma_{1000}$ of 30 and more emu/g as measured in a magnetic field of 1000 Oe. If the magnetization $\sigma_{1000}$ is less than 30 emu/g, attach to the image bearing member of carriers become apt to occur, thereby bringing about unfavorable effects. In particular, carriers of iron powder in a flat, rather than spherical shape, are preferable because of good charging ability.

Further, a mean particle size of 10 to 50 $\mu$m for carriers is especially preferable. That is why a sufficient charged quantity of toner is obtained for a mean particle size of 50 $\mu$m or less but its attach on image bearing member is apt to occur for a mean particle size of less than 10 $\mu$m.

Incidentally, mixed carriers of two and more sorts of the magnetic particles mentioned above are also allowable. For example, a mixture of large-particle-sized magnetic particles, 60 to 120 $\mu$m in mean diameter, and small-particle-sized magnetic particles, 10 to 50 $\mu$m in mean diameter, or small-particle-sized binder magnetic particles, 10 to 50 $\mu$m in mean diameter, are allowable. The mixing ratio should be determined from the consideration of size, magnetic characteristics, or other properties of magnetic particles.

Now, the toner to be mixed with the carriers mentioned above is made similarly to those of the first invention.

Incidentally, the measurements of magnetization values mentioned above were made similarly to those of the first invention. Further, those of specific volume resistivity and amount of triboelectric charge were made similarly to those of the first invention.

The constitution mentioned above permits a combined execution of removal of the residual toner and development of an electrostatic latent image by rubbing the surface of the image-bearing member with a magnetic brush formed directly on the outer surface of the permanent magnet constituting a means for supporting and conveying a magnetic developer in a sleeveless structure. Use of small-particle-sized toner also permits complete removal of the residual toner on the surface of the image-bearer. Thus, even in a constitution without a cleaning means, a high-quality image free of background fog can be developed and miniaturization of the whole device is enabled.

DETAILED DESCRIPTION OF THE PREFERRED EMBODIMENTS

Embodiment 1

Figure 1:
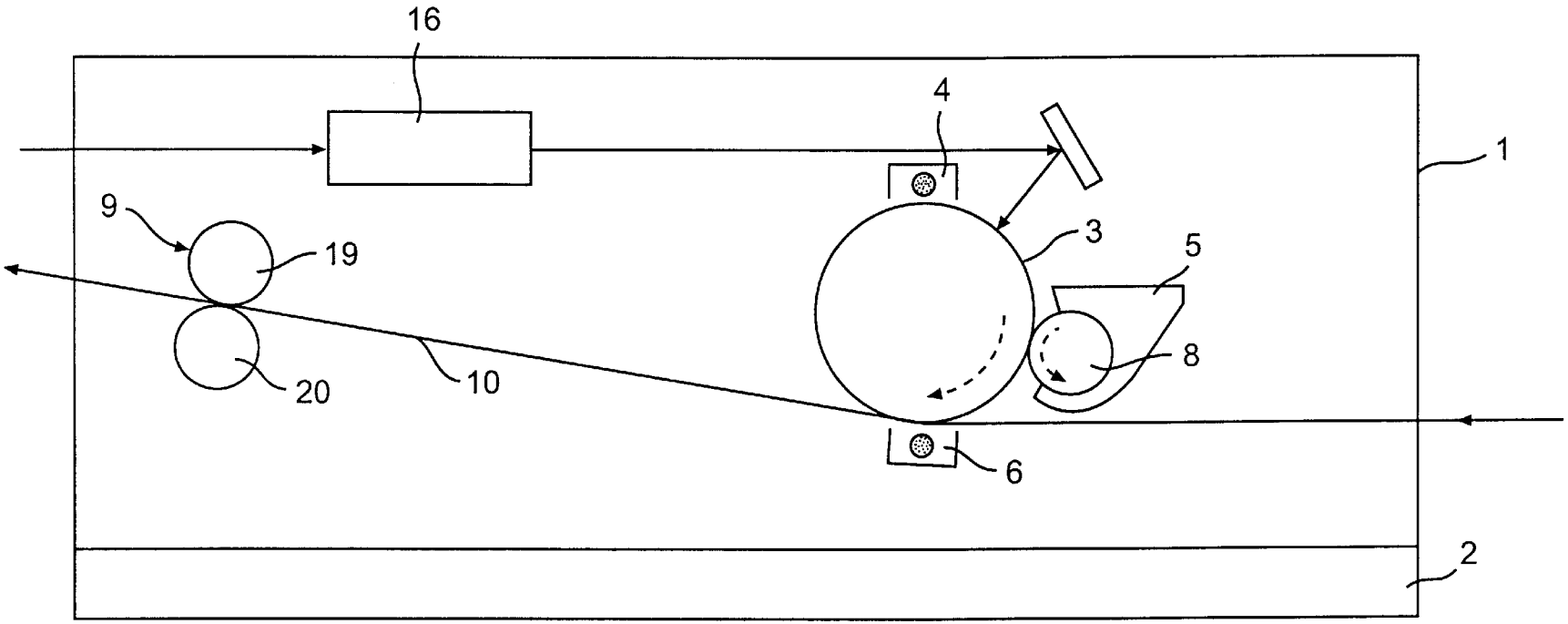
FIG. 1 is an explanatory drawing of principal constituents illustrating an image formation means for implementing the first invention.

FIG. 1 is an explanatory drawing of principal constituents illustrating an image formation means in one embodiment of the first invention. In FIG. 1, an image formation unit 1, accommodating constituent members described later, is provided as one-piece on a control unit 2. An image-bearing drum 3, shaped like a cylinder and having a photosensitive layer (not shown) comprising zinc oxide or organic semiconductor on the peripheral surface, is provided in such a manner as to be rotatable in the direction of the arrow within the image formation unit 1. A charger 4, a developing and cleaning unit 5 formed as described later and a transfer unit 6 are individually provided near the periphery of the image-bearing drum 3. A magnet roller 8 is rotatably provided on the developing and cleaning unit 5 and formed so as to face to the image-bearing drum 3.

Next, a fixer 9 is provided downstream from a recording paper path 10 of the image formation unit 1 and comprises a pressure contacting and rotatable formation of a heating roller 19 and a pressure roller 20. Incidentally, the heating roller 19 and pressure roller 20, each formed to be 20 mm in outer diameter, are constructed while kept in pressure contact with each other under a linear pressure of 0.5 kg/cm. The heating roller 19 comprises a heater, made of electricity resistant material, provided on the periphery of a core made of, say, aluminum alloy and a release layer, composed of, say, PTFE coated about 10 $\mu$m on the periphery thereof. Further, a pressure roller 20 comprises an outside layer, composed of silicon rubber on the periphery of a core made of material similar to that of the heating roller 19.

According to the construction mentioned above, individual constituent members within the image formation unit 1 are put into driving or operating states via the control unit 2 and an electric signal corresponding to a piece of information or an image is input to a laser scanner 16. Then, the image-bearing drum 3 is uniformly charged using the charger 4 and a laser beam respondent to said electric signal is illuminated on this charged surface, thereby forming a static charge image.

The static charge image is developed as a toner image by means of a magnetic developer to be attracted and conveyed by the magnet roller 8 in the developing and cleaning unit 5 and transferred with the transfer means 6 onto paper (not shown) moving along the paper feed path 10. The magnetic toner remaining on the image-bearing drum 3 after transfer of an image is removed therefrom simultaneously with the development of an electrostatic latent image on said developing and cleaning unit 5.

Thereafter, the paper bearing a toner image is fed to the fixer 9, heat of the heating roller 19 is propagated to the toner image on paper, a binding resin constituting the magnetic toner is fused, and fixation is accomplished.

Figure 2:
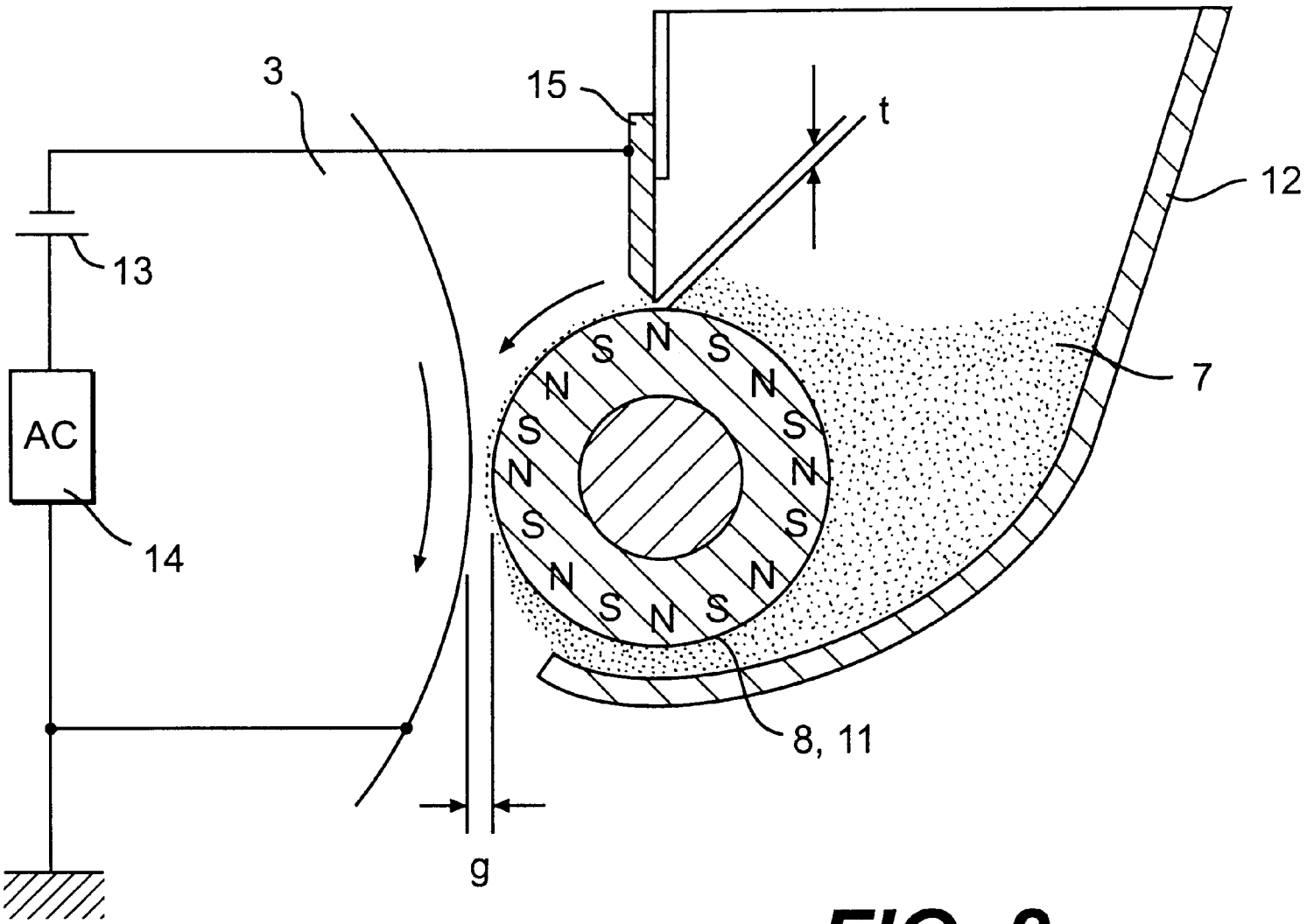
FIG. 2 is a principal enlarged transverse sectional view illustrating one example of the developing and cleaning unit 5 in FIG. 1.

FIG. 2 is a principal enlarged transverse sectional view illustrating one example of the developing and cleaning unit 5 in FIG. 1. In FIG. 2, a magnet roller 8, comprising a permanent magnet 11 made in one-piece of sintered permanent magnet such as hard ferrite magnet and having a plurality of magnetic poles axially extending on the peripheral surface, is provided rotatably at the bottom of the developer container 12. A DC power supply 13 and AC power supply 14, each connected between the doctor blade 15 and the image-bearing drum 3, are formed in such a manner that an alternate electric field with an AC bias superimposed on the DC bias can be applied between a magnetic developer 7 to be attracted and conveyed on the surface of the permanent magnet 11 and the image-bearing drum 3.

According to the constitution mentioned above, a magnetic developer 7 is attracted on the surface of the permanent magnet 11 constituting the magnet roller 8 and a magnetic brush (not shown) comprising a magnetic developer 7 rubs the surface of the image-bearing drum 3 in the region where the permanent magnet 11 opposite the image-bearing drum 3. Consequently, even after passing said transfer means 6 shown in FIG. 1, the toner remaining on the image-bearing drum 3 is removed and collected using a magnetic brush. At the same time, an electrostatic latent image on the image-bearing drum 3 is also developed using a magnetic brush.

The results of image formation by such means as mentioned above will be described. First, prepare a magnetic developer comprising magnetic toner and carriers. The magnetic toner used is produced using a grinding means, contains magnetic powder, is charged negatively, has a mean particle size of 8 $\mu$m and indicates a specific volume resistivity of $5\times10^{14}$ Ω.cm and an amount of triboelectric charge of −15 $\mu$c/g. It consists of 55% styrene-n-butyl methacrylate copolymer ($Mw=21\times10^4$, $Mn=1.6\times10^{14}$), 40% magnetic powder (Toda Kogyo Corp., EPT500), 3% polypropylene (Sanyo chemical Co., Ltd., TP32) and 2% charging control agent (Orient chemical Industries, Bontron S34) in weight.

Next, this toner is mixed with carriers comprising flat iron powder, average particle sige of 25 $\mu$m (surface-coated with silicone resin, specific volume resistivity: $10^7$ Ω.cm) for preparation of a magnetic developer and estimation of image quality is performed while varying the toner concentration. Table 1 shows the obtained results.

In this case, an image-bearing drum 3 shown in FIG. 2 is formed by OPC to set the surface potential at −600 V and the peripheral speed at 25 mm/s. A permanent magnet 11 is formed using cylinder-shaped ferrite magnet with an outer diameter of 20 mm, magnetic poles of 16, and a surface magnetic flux density of 400 G to set the number of rotation at 150 rpm, developing gap g at 0.5 mm, doctor gap t at 0.4 mm, DC bias voltage at −550 V, AC bias voltage Vp-p at 400 V and frequency at 500 Hz.

TABLE 1

| No. | Toner concentration (weight %) | Image density | Fog density | Cleaning ability |
|---|---|---|---|---|
| 1 | 10 | 1.30 | 0.07 | ○ |
| 2 | 30 | 1.38 | 0.09 | ○ |
| 3 | 50 | 1.40 | 0.10 | ○ |
| 4 | 70 | 1.42 | 0.11 | x |

Table 1 reveals that the image density rises and the degree of cleaning improves with increasing toner concentration in a magnetic developer. In No. 4, however, it is noticed that the fog density becomes higher and the cleaning ability is lowered.

The results of similar image estimation made with a magnetic developer composed of non-magnetic toner and carriers will be described. The non-magnetic toner is negative charged, average particle size of 9 μm, produced using a grinding means like the above-mentioned magnetic toner, and has a specific volume resistivity of $6\times10^{14}$ Ω.cm and amount of triboelectric charge of −23 μc/g. It consists of 85% styrene-n-butyl mathacrylate copolymer, 10% carbon black (Mitsubishi Chemical Industries, Ltd., #50), 3% polypropylene (Sanyo chemical Co., Ltd., TP32), 2% charging control agent (Orient chemical Industries, Bontron S34) in weight.

In a magnetic developer prepared by mixing the non-magnetic toner mentioned above with Cu—Zn ferrite carriers, average particle size of 30 μm, (Hitachi Metals Ltd., KBN-220, no surface coating), estimation of image quality was performed with varied toner concentration. Table 2 shows the obtained results.

In this case, a permanent magnet 11 shown in FIG. 2 is formed using cylinder-shaped ferrite magnet with an outer diameter of 20 mm, 32 magnetic poles, and a surface magnetic flux density of 250 G to set the developing gap g at 0.4 mm, doctor gap t at 0.35 mm, and DC bias voltage at −550 V. The other developing conditions are the same as with above-mentioned.

TABLE 2

| No. | Toner concentration (weight %) | Image density | Fog density | Cleaning ability |
|---|---|---|---|---|
| 5 | 10 | 1.35 | 0.08 | ○ |
| 6 | 30 | 1.37 | 0.10 | ○ |
| 7 | 50 | 1.41 | 0.10 | ○ |
| 8 | 70 | 1.43 | 0.13 | x |

As with FIG. 1, FIG. 2 reveals that No. 8 indicates a high fog density and a lower cleaning ability whereas Nos. 5 to 7 produce a distinct image and a good cleaning ability.

The results of estimation made for a magnetic developer containing apherical color toner produced by polymerization process will be described. First, color toner was produced, for example, as follows:

As raw material, 70 parts of styrene, 30 parts of n-butyl methacrylate, 0.5 part of divinyl benzene, 0.5 part of t-lauryl mercaptan, 2 parts of azo bisisobutylonitrile, 5 parts of magenta (C.I. pigment R122), 1.0 part of polyesteric dispersant (polyhexamethylene adipate) and 2 parts of charging control agent (Orient chemical Industries, Ltd., Bontron E-88) in weight were weighed, brought together, then mixed for 2 hours by means of a ball mill.

Next, put 1000 parts of ion exchange water and 15 parts of silica (Nippon Aerogel Co., Ltd., Aerogel #130) in a receptacle and stir by means of a homogenizer (Nippon Tokushu Kika Kogyo K.K., Homomixer), further add 0.5 part of γ-anilinomethyl trimethoxy silane (Torre Silicone Co., Ltd., SZ6083), and stir the mixture. Add the monomer-composed mixture into the dispersion medium, then disperse and granulate it for 10 minutes at 6000 rpm. After nitrogen substitution of the reaction receptacle, replace the homogenizer with a stirring apparatus having paddle stirring vanes, raise the temperature to 70° C. while continuing a stir at 120 rpm, and allow to react for 10 hours.

Put the obtained polymer in a cool water, dehydrate after filtration, alkali cleansing, and water cleansing, and drying under reduced pressure at 40° C. for 12 hours to obtain toner particles, average particle size of 6 μm. A specific volume resistivity and amount of triboelectric charge showed $9\times10^{10}$ Ω.cm and −29.5 μc/g, respectively.

In a magnetic developer prepared by mixing the non-magnetic color toner with flat iron powder, average particle size of 25 μm, (surface coated with silicone resin, a specific volume resistivity: $10^8$ Ω.cm), estimation of image quality was performed with varied toner concentration. Table 3 shows the obtained results.

In this case, a permanent magnet 11 shown in FIG. 2 is formed using a cylinder-shaped Sr ferrite type rubber magnet with an outer diameter of 20 mm, magnetic poles of 24, and a surface magnetic flux density of 200 G laid on the periphery of a steel-made shaft having an outer diameter of 6 mm to set developing gap g at 0.4 mm, doctor gap t at 0.3 mm, and DC bias voltage at −550 V. The other development conditions are the same as with the above-mentioned.

Table 3 is accompanied by control examples of image formation made with a magnet roller, formed by coaxially and rotatably installing a sleeve made of SUS304 around a permanent magnet 11 (formed of ferrite sintered magnet) with the main magnetic pole having a surface magnetic flux density of 650 G fixed opposite the image-bearing drum 3 shown in FIG. 2, Except for setting the number of rotations in a sleeve at 150 rpm, the other conditions are the same as with the Sr ferrite rubber magnet mentioned above.

TABLE 3

| Division | No. | Toner concentration (weight %) | Image density | Fog density | Cleaning ability | Scatter of toner |
|---|---|---|---|---|---|---|
| Embodiment | 9 | 5 | 1.33 | 0.07 | ○ | No |
| | 10 | 10 | 1.37 | 0.08 | ○ | No |
| | 11 | 20 | 1.41 | 0.08 | ○ | No |
| | 12 | 30 | 1.41 | 0.09 | x | No |
| Control | 13 | 5 | 1.25 | 0.08 | Δ | No |
| | 14 | 7 | 1.30 | 0.09 | x | Yes |
| | 15 | 10 | 1.35 | 0.13 | x | Yes |

Table 3 reveals that No. 13 in the control shows not only a low image density but also rather less cleaning ability, and image density and fog density simultaneously rise, lowering the cleaning ability, scattering toner, and deteriorating the image quality noticeably, with increasing toner concentration. In contrast with this, a high-quality image was confirmed to be obtained for the embodiment. Although only No. 12 shows low cleaning ability yet Nos. 9 to 11 shows little fog and good cleaning ability.

In the embodiment 1, a DC power supply 13 and AC power supply 14 are connected to the doctor blade 15, but may be connected to the surface of the magnet roller 8 on which a metal layer (e.g., SUS304 foil, thickness of 10 μm) is formed, giving a similar image.

Because of having the constitution and operation described above, the first invention can provide the following effects:

(1) Since the magnet roller comprises only a permanent magnet and a sleeve and a cleaning means can be omitted, the developing device and image forming device can be made smaller in size.

(2) Since a magnetic developer is so constructed as to be attracted directly and conveyed on the surface of a permanent magnet, the conveyability and stability in the shape of a magnetic brush improves and the developing and cleaning ability is good, thus producing a high-quality image.

(3) Even if toner in a magnetic developer is small-particle-sized and/or spherical, the residual toner in the developing and cleaning region can be completely removed and collected from the surface of the image-bearing body.

(4) Since the toner concentration in a magnetic developer can be set over a wide range, a toner concentration control means, for example, need not to be used, thus permitting the whole apparatus to be made compact.

Embodiment 2

Figure 3:
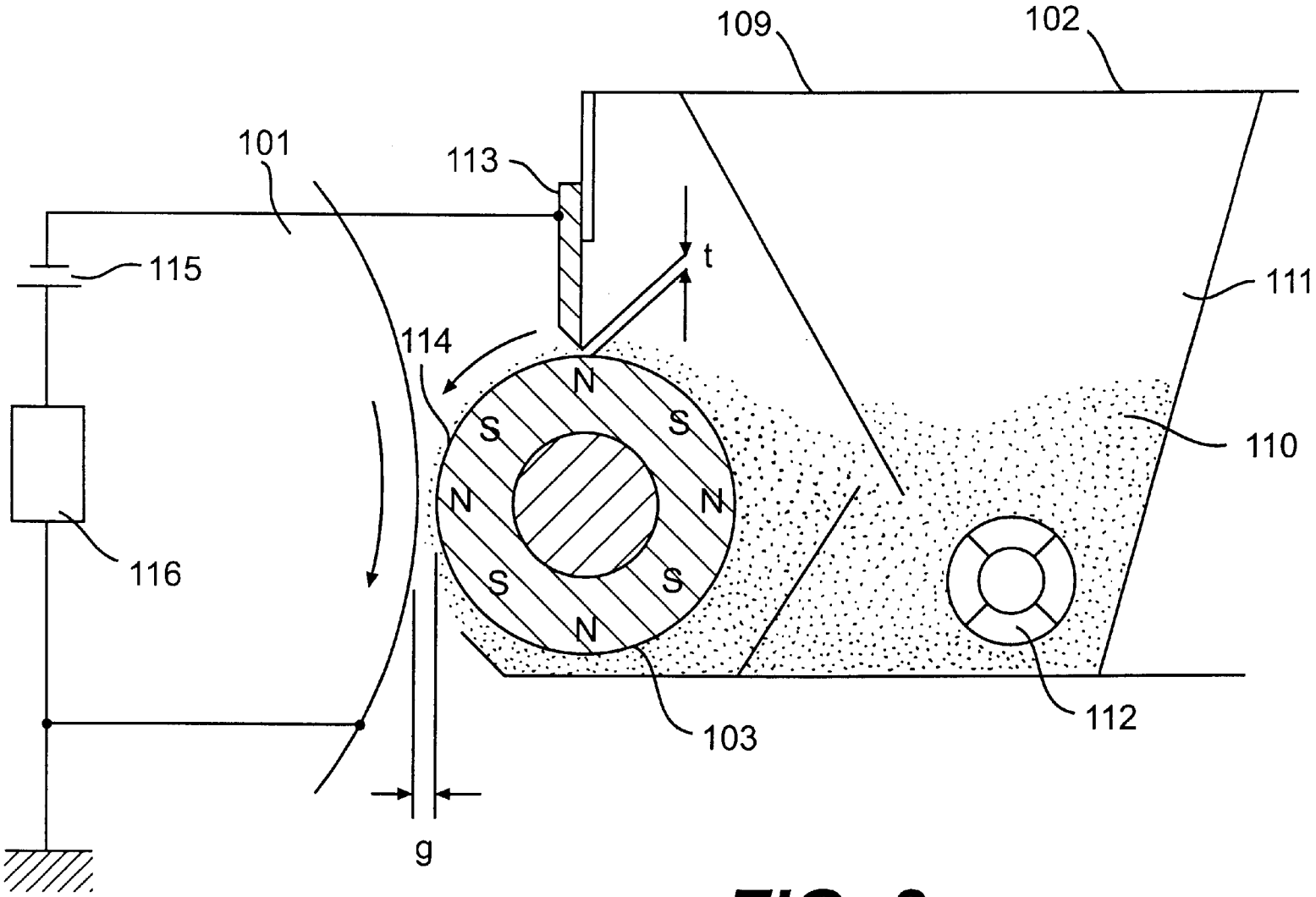
FIG. 3 is a principal transverse sectional view illustrating one example of a developing unit for implementing the second invention.
Figure 6:
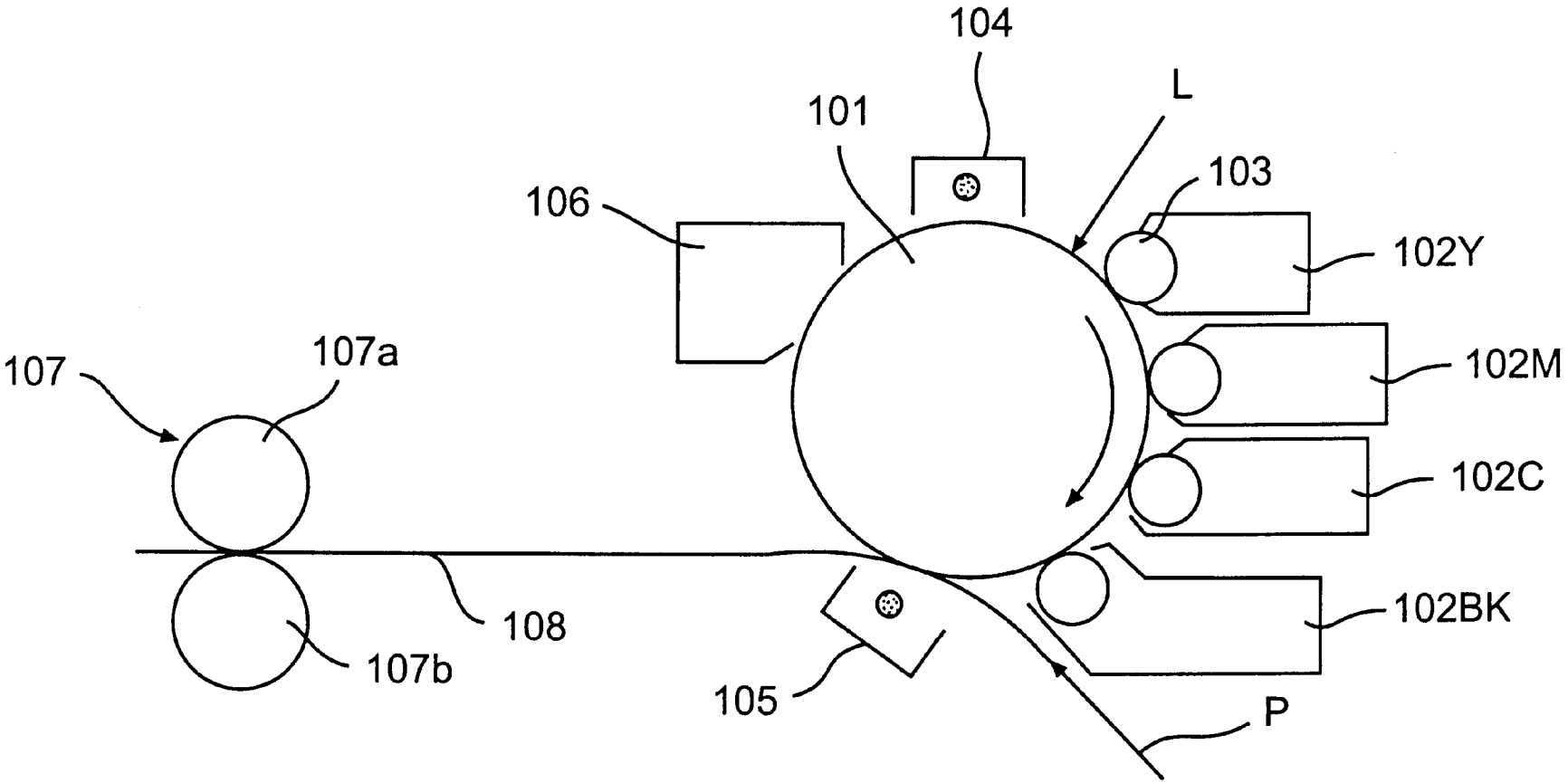
FIG. 6 (PRIOR ART)
FIG. 6 is a principal constituent explanatory drawing illustrating a conventional color image forming device.

FIG. 3 is a principal sectional view illustrating one example of a developer in the embodiment of the second invention and like constituent is denoted by the same reference symbol as with FIG. 6. The developing unit 102 in FIG. 3 corresponds to the developing unit 102Y, 102M, 102C, 102BK shown in FIG. 6 and differs only in the color of accommodated toner but is identical in constitution. The developing roller 103 is formed like a cylinder using, say, an isotropic ferrite magnet with a plurality of magnetic poles axially extending being so arranged on the peripheral surface that N and S poles may appear alternatively, and rotatably provided on the left bottom end of the developer container 109. Reference Symbol 110, 111, and 112 denote a developer reserver, toner reserver, and stirring vanes, respectively.

A doctor blade 113 is provided via a doctor gap t spaced from the surface of the developing roller 103 at the lateral part of the developer container 109 for controlling the layer thickness of magnetic developer 114 to be attracted on the surface of the developing roller 103. A DC power supply 115 and AC power supply 116 are connected between the image-bearing drum 101 and the doctor blade 113 and used for applying an alternate electric field with superimposition of a DC bias and AC bias to between the image-bearing drum 101 and the magnetic developer 114. Symbol g denotes a development gap. By disposing four developing unit 102 as constituted above close by the image-bearing drum 101 as shown in FIG. 6, the image forming device is formed. That is, in FIG. 3, a rotation of the developing roller 3 in the direction of the arrow causes magnetic developer 114 to be attracted and conveyed on the surface of the developing roller 103. When the magnetic developer 114 reaches the developing region opposite the image-bearing drum 101, toner in the magnetic developer 114 is put to an image formed on the surface of the image-bearing drum 101 under action of an alternate electric field with superimposition of an AC bias and DC bias, thereby permitting a development of the image. Consequently, a color image comprising the image of each individual color superposed thereon can be formed.

The results of image formation using the developing unit 102 shown in FIG. 3, will be described. First, prepare a magnetic developer mainly comprising non-magnetic toner and magnetic carriers. The black toner used consists of 85% styrene-acryl copolymer, 10% coloring agent (carbon black, Mitsubishi Chemical Industries, Ltd., #44), 3% polypropylene (Sanyo chemical Co., Ltd., TP32) and 2% charging control agent (Orient chemical Industries, Bontron S34) in weight.

Toner of a color other than black consists of 90% polyester (Nippon Carbide Industries Co., Ltd., NCP11), 8% coloring agent, 1% polypropylene (Sanyo chemical Co., Ltd., TP32) and 1% charging control agent (Orient chemical Industries, Bontron E88 (white)) in weight, where cyan: C.I. pigment blue 15-3,magenta: C.I. pigment red 122 and yellow: C.I. pigment yellow 12 are used as coloring agents. Each individual toner mentioned above averages particle size of 7 $\mu$m.

A magnetic developer is prepared by mixing said non-magnetic toner and flat iron powder, average particle size of 25 $\mu$m (coated with silicone resin) and estimation of image quality (provided for monocolor images) is performed with varied toner concentration. Table 4 shows the obtained results.

In this case, the image-bearing drum 101 shown in FIG. 3 is formed by OPC to set the surface potential at −500 V and the peripheral speed at 25 mm/s. The developing roller 103 is formed using a cylinder-shaped ferrite magnet with an outer diameter of 20 mm, magnetic of 16 poles, and the surface magnetic flux density of 550 G to set the number of rotations at 150 rpm, developing gap g at 0.6 mm, doctor gap t at 0.3 mm, DC bias voltage at −450 V, AC bias voltage Vp-p at 800 V, and frequency at 200 Hz. The image is fixed by use of heat roller on which silicone oil supplied by sponge roller. Imagine densities in Table 4 are measured using a filter expect for black.

TABLE 4

| No. | Toner concentration (weight %) | Kind of color | Image density | Fog density | absence of spreadness of toner | Fine line unevenness |
|---|---|---|---|---|---|---|
| 1 | 5 | cyan | 1.28 | 0.07 | ○ | ○ |
| 2 | 10 | magenta | 1.33 | 0.08 | ○ | ○ |
| 3 | 30 | yellow | 1.40 | 0.08 | ○ | ○ |
| 4 | 50 | black | 1.38 | 0.09 | ○ | ○ |
| 5 | 60 | cyan | 1.39 | 0.10 | ○ | ○ |
| 6 | 70 | magenta | 1.40 | 0.13 | Δ | Δ |

Table 4 reveals that the image density generally increases with rising toner concentration, but in No. 6 the fog density also increases, dust and a fine-line unevenness occurs and the image quality deteriorates. In contrast with this, Nos. 1 to 5 were confirmed to give a high-quality image without spread of toner or fine-line unevenness.

In the embodiment 2, jumping development with non-magnetic toner used also for a black image are described, but single-component magnetic toner may be used or a mixture of magnetic toner and carriers may be used for forming a black image. Further, a contact type where a magnetic brush rubs the surface of an image-bearing drum may be also used as a developing process.

Though connected to the doctor blade 113, an DC power supply 115 and AC power supply 116 may be connected to the surface of the magnet roller 103 on which a metal layer is formed as mentioned above, giving a similar image.

Because of having the constitution and operation described above, the second invention provides the following effects:

(1) Since the developing roller comprises only a permanent magnet and directly adsorbs and conveys magnetic developer on its outer surface, a stable magnetic brush is formed, thus permitting a high quality image without scattering of toner or contaminating of color to be formed.

(2) Since the permanent magnet serving as a support means for magnetic developer is a hard material, the surface hardly wears and is not liable to deteriorate with age, thereby permitting a promotion in durability.

(3) Even for a larger development gap, a stable high-quality image can be obtained.

(4) Since the toner concentration in a magnetic developer can be set over a wide range, a toner concentration control means, for example, need not to be used, thus permitting the whole apparatus to be made compact.

(5) A permanent magnet constituting the developing roller needs no higher precision working than is required, thus permitting a reduction in production cost.

Embodiment 3

Figure 4:
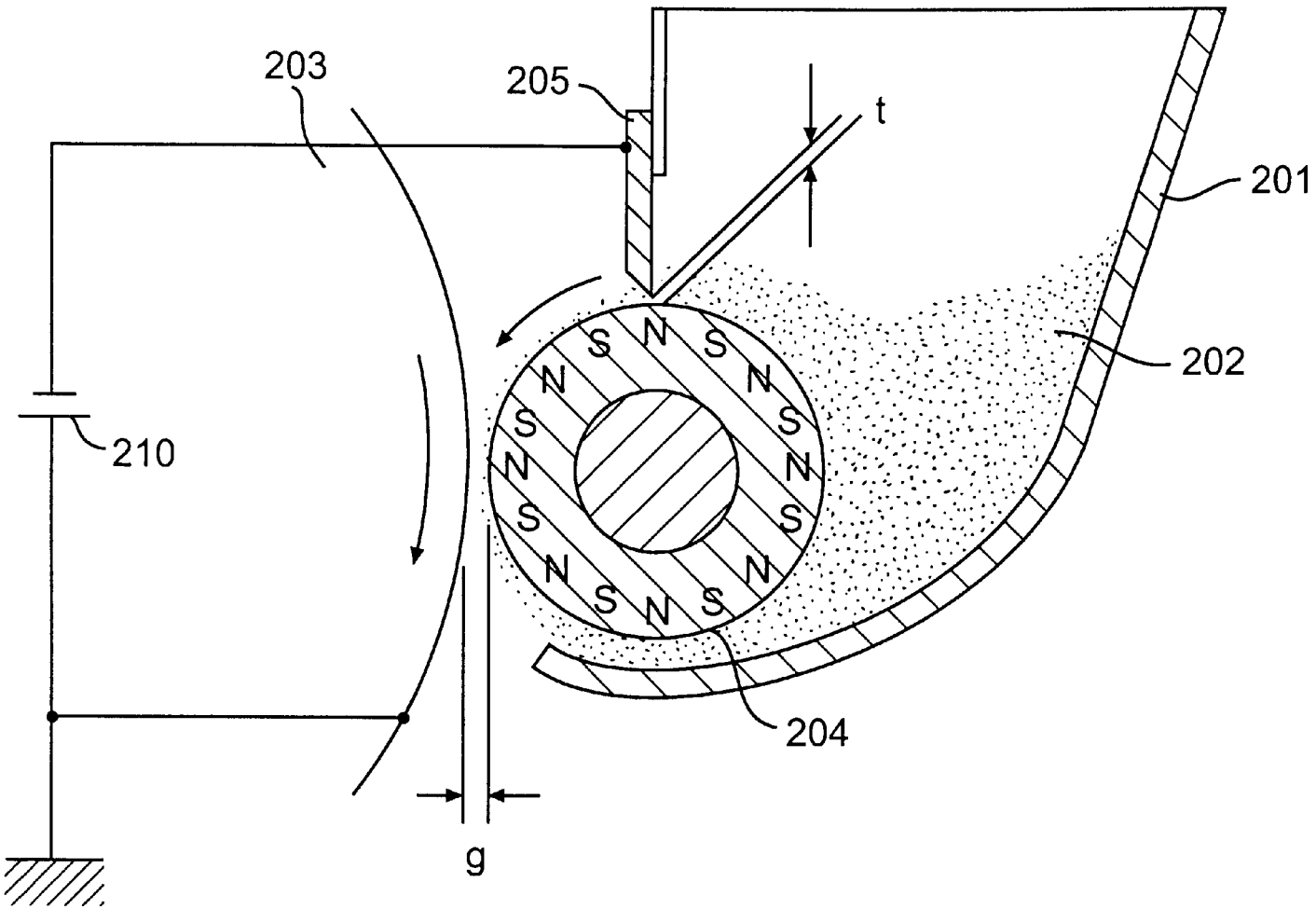
FIG. 4 is a principal transverse sectional view illustrating one example of a developing unit for implementing the third invention.
Figure 5:
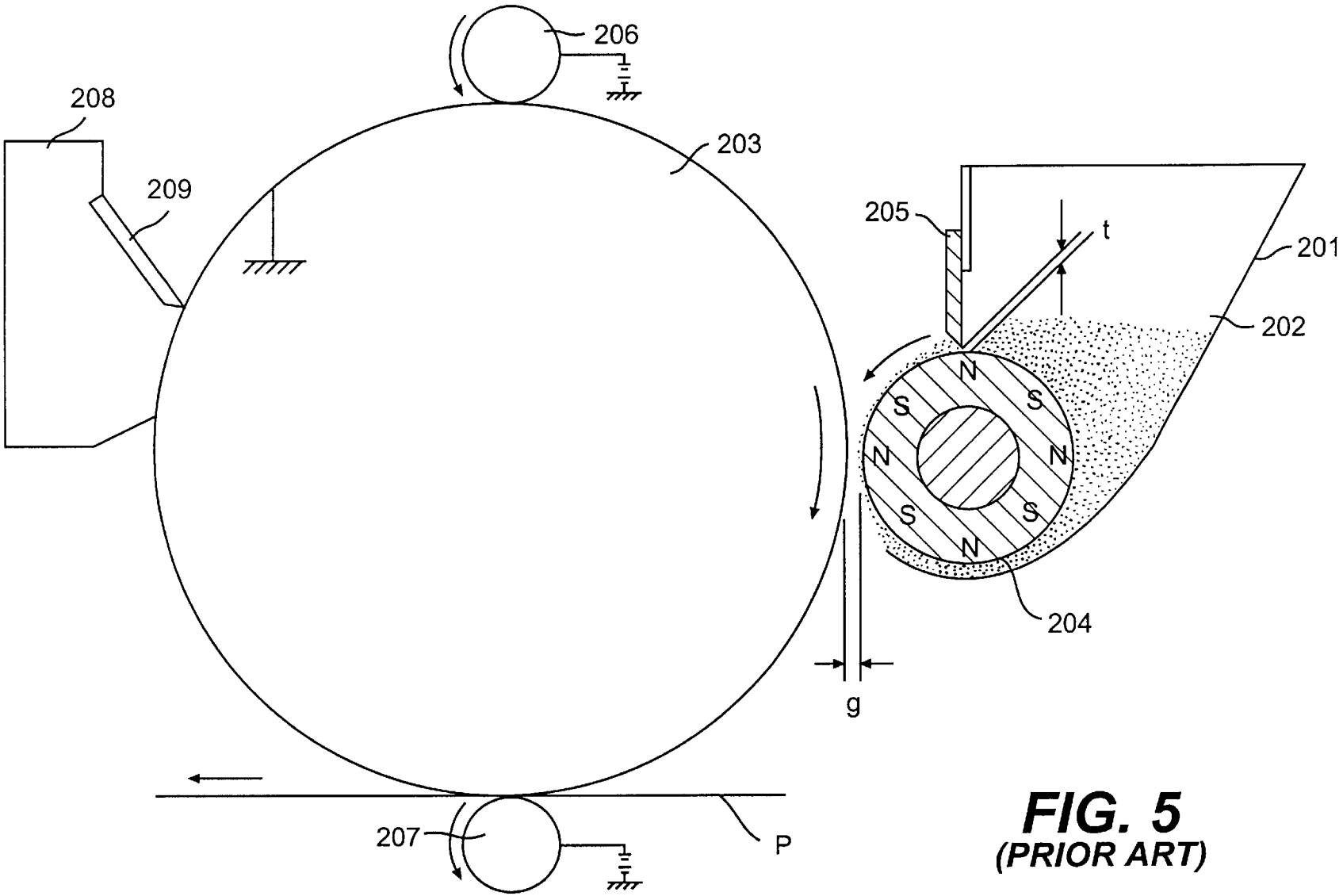
FIG. 5 (PRIOR ART)
FIG. 5 is a principal explanatory drawing illustrating one example of developing unit with a sleeveless developing roll.

FIG. 4 is a principal transverse sectional view illustrating one example of a developing unit in the embodiment of the third invention and like components are denoted by the same reference symbol as with FIG. 5. The permanent magnet 204 in FIG. 4 is formed of a semiconductive or insulating, say, isotropic ferrite magnet having a specific volume resistivity of more than $10^6$ Ω.cm, on whose peripheral surface a plurality of magnetic poles axially extending are provided in a cylindrical shape, and is rotatably provided on the bottom end of the developer container 201. A DC power supply 210 is connected between the doctor blade 205 and the image-bearing drum 203.

A magnetic toner is prepared as negatively charged particles, average particle size of 7 μm and having a specific volume resistivity of $2\times10^{14}$ Ω.cm and amount of triboelectric charge of −21.5 μc/g. The ratio of each constituent is as follows: polyester resin (Nippon Carbide Industries Co., Ltd., NCP33B) 70; magnetite (Toda Kogyo Corp., EPT500) 2.5; polypropylene (Sanyo chemical Co., Ltd., TP32) 4; and charging control agent (Orient chemical Industries, Bontron E81) 1. To the particles formed of these constituents is added an external additive (Nippon Aerogel Co., Ltd., R972) 0.5.

As magnetic carriers, Ba—Ni—Zn ferrite (Hitachi Metals Ltd., KBN-100), distributing from 10 to 37 μm and averaging 18.5 μm in particle size, indicating a value shown in Table 5 of magnetization $\sigma_{1000}$ in 1000 Oe, and having a specific volume resistivity of $7.2\times10^8$ Ω.cm.

Further, the image-bearing drum 203 is formed by OPC to set the surface potential at −700 V and the peripheral speed at 25 mm/s. The permanent magnet 204 is so formed as to have an outer diameter of 20 mm, magnetic poles of 16, and a surface magnetic flux density of 500 G to set the developing gap g at 0.4 mm, doctor gap t at 0.3 mm, and DC bias voltage at −550 v. Table 5 shows the results of image estimation with varied toner concentration and $\sigma_{1000}$.

TABLE 5

| No. | Initial toner concentration (weight %) | $\sigma_{1000}$ (emu/g) | Image density | Fog (%) |
|---|---|---|---|---|
| 1 | 3 | 48 | 1.15 | 0.12 |
| 2 | 5 | | 1.33 | 0.07 |
| 3 | 30 | | 1.35 | 0.15 |
| 4 | 50 | | 1.37 | 0.18 |
| 5 | 80 | | 1.37 | 0.27 |
| 6 | 85 | | 1.37 | 0.76 |
| 7 | 50 | 10 | 1.36 | 0.22 |
| 8 | | 20 | 1.36 | 0.25 |
| 9 | | 35 | 1.35 | 0.15 |

Table 5 reveals that with a value of $\sigma_{1000}$ kept constant and varied toner concentration, No. 1 shows a low-value image density because of a low toner concentration, whereas No. 6 shows the occurrence of fog because of a high toner concentration. In contrast with these, Nos. 2 to 5 show a high image density and no fog, thus providing a good image.

In cases with the toner concentration kept constant and varied low values of $\sigma_{1000}$, Nos. 7 to 9 provide a good image without attach to the image-bearing member of carriers or occurrence of fog.

Ten thousand continuous printing tests under conditions of No. 4 in Table 5 provided a good image in which the toner concentration varies within the range of 45 to 60 weight %, the image density is 1.35 or over, and the occurrence of fog is 0.5% or less. However, the torque of the permanent magnet 204 (cf. FIG. 4) remains at a value of 0.7 kg cm.

As the control, an image formation was performed by applying the aforesaid magnetic developer to an image forming means of a type allowing the sleeve alone to rotate with the sleeve disposed outside the aforesaid permanent magnet 204. The obtained results show that the surface magnetic flux density of the permanent magnet 204 is 850 G (790 G on the sleeve), the toner concentration without occurrence of fog ranges from 20 to 30 weight % but fog exceeds 0.5% for a toner concentration of more than 30 weight %, and attach to the image-bearing member of carriers occurs for a toner concentration of less than 20 weight %. Next, non-magnetic toner, average particle size of 8.5 μm, indicating a specific volume resistivity of $5\times10^{14}$ Ω.cm and an amount of triboelectric charge of −25.8 μc/g, is prepared. It consists of 87% styrene-acryl resin, 8% carbon black (Mitsubishi Chemical Industries Ltd., MA-100), 1% charging control agent (Orient chemical Industries, Bontron S-34), and 4% polypropylene (Sanyo chemical Co., Ltd., TP32) in weight. To the particles formed of these constituents is added 0.5% external additive (Hextwacker Co., Ltd., H2000).

As magnetic carriers, resin bonded carriers, average particle size of 10 μm, indicating a specific volume resistivity of $5\times10^8$ Ω.cm and magnetization $\sigma_{1000}$=35 emu/g are used. It consists of 49% stylen-acryl resin, 50% magnetite (Kanto Denka, K.K., KBC-100), and 1% charging control agent (Orient chemical Industries, Oil Black BY) in weight. Onto the surface of particles formed of these constituents is deposited 0.5 weight % carbon black (Mitsubishi Chemical Industries Ltd., MA-600). The triboelectric charge is +5.1 μc/g.

Further, the image-bearing drum 203 shown in FIG. 4 is formed in a manner similar to that of the first and second embodiments. The permanent magnet 204 is so formed as to have an outer diameter of 20 mm, magnetic poles of 32, and a surface magnetic flux density of 400 G to set the developing gap g at 0.4 mm, doctor gap t at 0.25 mm, and DC bias voltage at −600 V. Table 6 shows the results of image estimation with varied toner concentration.

TABLE 6

| No. | Initial toner concentration (weight %) | $\sigma_{1000}$ (emu/g) | Image density | Fog (%) |
|---|---|---|---|---|
| 11 | 3 | 35 | 1.20 | 0.10 |
| 12 | 5 | | 1.31 | 0.15 |
| 13 | 40 | | 1.36 | 0.22 |
| 14 | 70 | | 1.37 | 0.30 |
| 15 | 85 | | 1.37 | 0.85 |

Table 6 reveals that No. 11 with a toner concentration of 3% shows a low image density, whereas No. 15 with a toner concentration of 85% shows occurrence of fog. In contrast with these, Nos. 12 to 14 provide a good image without fog and with a high image density.

Ten thousand continuous printing tests under conditions of No. 13 in Table 6 provided a good image in which the toner concentration varies within the range of 40 to 65 weight % without being equipped with a toner concentration sensor, the image density is 1.35 or over, and the occurrence of fog is 0.5% or less. However, the torque of the permanent magnet 204 (cf. FIG. 4) remains at a value of 0.3 kg-cm.

As control, image formation was performed by using a magnetic developer comprising the aforesaid one and spherical reduced iron powder carriers ($\sigma_{1000}$ Oe=125 emu/g), average particle size of 100 μm (distributing from 74 to 149 μm), under conditions (initial toner concentration of 10 weight %) similar to the aforesaid. The obtained results show that the toner concentration varies from 10 to 20 weight %. Occurrence of fog is observed for a toner concentration of not less than 15 weight % and the torque of the permanent magnet 204 needs 2.0 kg-cm.

On the contrary, continuous printing tests at an initial toner concentration of 10 weight % while being equipped with a toner concentration sensor shows that fog exceeds 0.5% for 5,000 or more print tests and exceeds 1% for 10,000 print tests. In addition, spent phenomena are noticed on the surface of magnetic carriers.

Though connected to the doctor blade 205 in the embodiment 3, an DC power supply 210 may be connected to the surface of the developing roller, on which a metal layer is formed as mentioned above, comprising a permanent magnet 204, giving a similar image.

Because of having the constitution and operation described above, the third invention can provide the following effects:

(1) Since the developing roller comprises only a permanent magnet, the developing device can be made small in size, thus permitting the whole image forming device to be miniaturized.

(2) Since the permanent magnet serving as a support means for magnetic developer is a hard material, the surface hardly wears and is not liable to deteriorate with age, thereby permitting a promotion in durability.

(3) Use of small-grain-sized magnetic carriers permits a high-precision and high-quality image to be obtained.

(4) Since the toner concentration in a magnetic developer can be set over a wide range, a toner concentration control means, for example, need not to be used, thus permitting the whole apparatus to be made compact.

(5) A permanent magnet constituting the developing roller needs no higher precision working than is required, thus permitting a reduction in production cost.

Embodiment 4

In the embodiment of the fourth invention, emulsion (solid components: 20 weight %) comprising stylene-acrylic copolymer particles, not greater than 1 μm in grain size, is obtained by allowing to polymerization react at 70° C. for 8 hours after stirring 91 parts of styrene, 8.7 parts of 2-ethyl hexyl acrylate, and 0.3 part of divinyl benzene, in a water solution composed of 400 parts of ion exchange water, 1 part of hydroxypropylcellulose, and 5 parts of potassium persulfate in weight and dropping the mixed solution in an atmosphere of nitrogen.

Disperse 80 parts of magnetic powder (Toda Corp., MTA-305) previously surface processed with silane coupling agent (Toray Silicone Co., Ltd., SZ6083) and 1 part of charging control agent (Nippon Chemical Industrial Co., Ltd., KAYA Charge T-2N) in 500 parts of the emulsion and hold it while stirring at 70° C. for 3 hours.

In this case, because of being processed above the glass transition temperature of resin components, particles including polymers aggregate and aggregations, average particle size of 7 μm, are formed. After cooling, add 0.5 part of silica (Wacker Co., Ltd., H-2000) to aggregated particles obtained by filtration, water washing, and vacuum drying, thus producing a magnetic toner. This magnetic toner indicates a specific volume resistivity of $10^{15}$ Ω.cm and an amount of charge of −26 μc/g.

As the control, obtain magnetic toner (spherical particles) having a composition similar to the aforesaid by a publicly known polymerization process. This magnetic toner has an average particle size of 6.5 μm and indicates a specific volume resistivity of $10^{15}$ Ω.cm and an amount of triboelectric charge of −18 μc/g.

A magnetic developer is obtained by mixing the aforesaid magnetic toner with magnetic carriers indicating a specific volume resistivity of $10^{11}$ Ω.cm, prepared by surface coating hetero shaped iron powder, average particle size of 25 μm, with silicone resin, and developing is performed using a developer shown in FIG. 5. Table 7 shows the results of image estimation in this development.

In this case, the image-bearing drum 203 shown in FIG. 5 is formed by OPC to set the surface potential at −600 V and the peripheral speed at 25 mm/s. The permanent magnet 204 is formed using cylinder-shaped ferrite magnet with an outer diameter of 20 mm, magnetic poles of 16, and the surface magnetic flux density of 400 G to set the number of rotations at 150 rpm a developing gap g at 0.5 and a doctor gap t at 0.4 mm. An alternate electric field with an AC bias voltage Vp-p=400 V superimposed on the DC bias voltage of −550V is applied through the doctor blade 205 at a frequency of 500 Hz.

TABLE 7

| Division | No. | Toner concentration (weight %) | Image density | Background fog | Cleaning ability | Life of image-bearing drum (sheet) |
|---|---|---|---|---|---|---|
| Embodiment | 1 | 5 | 1.38 | 0.8 | ○ | ≧100,000 |
| | 2 | 10 | 1.39 | 0.9 | ○ | ≧100,000 |
| | 3 | 15 | 1.42 | 1.3 | ○ | ≧100,000 |
| | 4 | 40 | 1.41 | 1.4 | ○ | ≧100,000 |
| | 5 | 50 | 1.41 | 1.5 | ○ | ≧100,000 |
| | 6 | 60 | 1.46 | 2.3 | ○ | ≧100,000 |
| | 7 | 70 | 1.47 | 2.7 | ○ | ≧100,000 |
| Control | 8 | 15 | 1.36 | 7.5 | x | 20,000 |

Note: Background fog is determined by visual inspection. Because the value is smaller, the background less.
(Practical range: 2 or less)

Table 7 reveals that use of globular magnetic toner for control brings about a much background fog, poor cleaning ability, and a short life for the ion-bearing drum. In Nos. 6 and 7, background fog is somewhat large. On the contrary, Nos. 1 to 5 bring about a high image density, slight background fog, and a good cleaning ability, and can improve the life of the image-bearing drum more than five times than that of the conventional. The toner concentration is found to be set preferably at 5 to 50 weight %.

The embodiment 4 describes one example using a two-component magnetic developer comprising magnetic toner and magnetic carrier, but a two-component developer containing non-magnetic toner or a single-component developer comprising only magnetic toner can be expected to bring about similar effects.

Though applied to the doctor blade 205 in the embodiment 4, voltage may be applied to the surface of the developing roller, on which a metal layer is formed as mentioned above, comprising a permanent magnet 204, giving a similar image.

Because of having the constitution and operation described above, the fourth invention can provide the following effects:

(1) Since toner in a magnetic developer in non-spherical, the residual toner, even if small in particle size, can be easily and completely removed and collected from the surface of the image-bearing body.

(2) Since the residual toner can be removed from the surface of the image-bearing body, formation of toner film is prevented and the life of the image-bearing body can be prolonged.

(3) Since the developer comprising only a permanent magnet, the sleeve can be omitted, thus permitting the developing device and image forming device to be made small in size.

(4) Since a magnetic developer is so arranged as to be directly attracted and held on the surface of a permanent magnet, the conveyability and the stability in the shape of a magnetic brush improves and the developing ability is good, thus permitting a high-quality image to be obtained.

(5) In the case of using a two-component magnetic developer, the toner concentration in a magnetic developer can be set over a wide range and a toner concentration control means can be omitted, thus permitting the whole apparatus to be made compact.

What is claimed:

1. A color image forming method for operating a moving image-bearing member bearing an electrostatic latent image and a plurality of developing units disposed near the image-bearing member and being selectively operable, said color image forming method developing said electrostatic latent image by using a magnetic developer brush formed on the surface of a developer support and conveyance means, and comprising the steps of:

providing a rotating cylinder for supporting and conveying said magnetic developer, said cylinder including a permanent magnet with a plurality of magnetic poles on the cylinder surface;

supplying a magnetic developer containing non-magnetic color toner for color image formation;

attracting and conveying a layer of magnetic developer having a thickness smaller than the gap between the image-bearing member and said developer support and conveyance cylinder on the cylinder surface; and applying in the developing region an alternate electric field with an AC bias superimposed on a DC bias between the image-bearing member and the magnetic developer for the developing of an electrostatic latent image on the image-bearing member, wherein letting Vp (mm/s) be the moving speed of the image-bearer, and D (mm), M, and Vm (mm/s) be the outer diameter, the number of magnetic poles, and peripheral speed of the permanent magnet, respectively, a value of h, being defined as $\pi D \cdot Vp/(M \cdot Vm)$, has a value of 2 or less, and the surface magnetic flux density ranges from 50 to 1200 G.

2. An image forming method according to claim 1 wherein a magnetic developer containing 5 to 60 weight % of non-magnetic color toner is employed.

3. The image forming method according to claim 1, wherein:

said magnet surface further comprises a conductive layer formed thereon.

* * * * *